US012742360B2

(12) United States Patent
Clausen et al.

(10) Patent No.: US 12,742,360 B2
(45) Date of Patent: Sep. 22, 2026

(54) DEPTH ACTIVATED DOWNHOLE ADJUSTABLE BEND ASSEMBLIES

(71) Applicant: National Oilwell Varco, L.P., Houston, TX (US)

(72) Inventors: Jeffery Ronald Clausen, Tulsa, OK (US); Nicholas Ryan Marchand, Edmonton (CA)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 19/267,015

(22) Filed: Jul. 11, 2025

(65) Prior Publication Data

US 2025/0341138 A1 Nov. 6, 2025

Related U.S. Application Data

(63) Continuation of application No. 18/719,338, filed as application No. PCT/US2022/053199 on Dec. 16, 2022, now Pat. No. 12,385,337.

(60) Provisional application No. 63/290,426, filed on Dec. 16, 2021.

(51) Int. Cl.

| | |
|---|---|
| ***E21B 7/06*** | (2006.01) |
| ***E21B 21/08*** | (2006.01) |
| ***E21B 34/06*** | (2006.01) |

(52) U.S. Cl.

CPC ..... *E21B 21/08* (2013.01); *E21B 34/063* (2013.01); *E21B 7/067* (2013.01)

(58) Field of Classification Search

CPC ..... E21B 4/02; E21B 7/067; E21B 7/068

See application file for complete search history.

(56) References Cited

U.S. PATENT DOCUMENTS

| | | | | |
|---|---|---|---|---|
| 3,455,401 | A * | 7/1969 | Taylor, Jr. | E21B 7/068 175/45 |
| 4,303,135 | A * | 12/1981 | Benoit | E21B 7/067 175/73 |
| 5,458,208 | A * | 10/1995 | Clarke | E21B 17/04 175/45 |
| 5,495,900 | A * | 3/1996 | Falgout, Sr. | E21B 4/02 175/325.2 |
| 7,287,607 | B1 * | 10/2007 | Falgout, Sr. | E21B 7/068 175/74 |

(Continued)

*Primary Examiner* — Kenneth L Thompson

(74) *Attorney, Agent, or Firm* — Conley Rose, P.C.

(57) ABSTRACT

A downhole mud motor includes a driveshaft rotatably disposed in a driveshaft housing, a bearing mandrel coupled to the driveshaft, wherein the bend adjustment assembly includes a first configuration that provides a first deflection angle between the driveshaft housing and the bearing mandrel, wherein the bend adjustment assembly includes a second configuration that provides a second deflection angle between the driveshaft housing and the bearing mandrel, and a locking assembly including a locked configuration configured to lock the bend adjustment assembly into one of the first configuration and the second configuration until the downhole mud motor has at least one of reached a predefined depth in the wellbore, and a mud weight has reached a predefined mud weight threshold at a given depth, in response to which the locking assembly is configured to actuate from the locked configuration to an unlocked configuration.

20 Claims, 22 Drawing Sheets

(56) References Cited

U.S. PATENT DOCUMENTS 12,209,496 B2 * 1/2025 Clausen ..... E21B 47/024
12,385,337 B2 * 8/2025 Clausen ..... E21B 21/08

* cited by examiner

DEPTH ACTIVATED DOWNHOLE ADJUSTABLE BEND ASSEMBLIES

CROSS-REFERENCE TO RELATED APPLICATIONS

This application is a continuation of U.S. non-provisional patent application Ser. No. 18/719,338 filed Jun. 13, 2024, entitled "Depth Activated Downhole Adjustable Bend Assemblies", which is a 35 U.S.C. § 371 national stage application of PCT/US/2022/053199 filed Dec. 16, 2022, entitled "Depth Activated Downhole Adjustable Bend Assemblies", which claims benefit of U.S. provisional patent application No. 63/290,426 filed Dec. 16, 2021, entitled "Depth Activated Downhole Adjustable Bend Assemblies," all of which are hereby incorporated herein by reference in their entirety for all purposes.

STATEMENT REGARDING FEDERALLY SPONSORED RESEARCH OR DEVELOPMENT

Not applicable.

BACKGROUND

In drilling a wellbore into an earthen formation, such as for the recovery of hydrocarbons or minerals from a subsurface formation, it is typical practice to connect a drill bit onto the lower end of a drillstring formed from a plurality of pipe joints connected together end-to-end, and then rotate the drillstring so that the drill bit progresses downward into the earth to create a wellbore along a predetermined trajectory. In addition to pipe joints, the drillstring typically includes heavier tubular members known as drill collars positioned between the pipe joints and the drill bit. The drill collars increase the weight applied to the drill bit to enhance its operational effectiveness. Other accessories commonly incorporated into drillstrings include stabilizers to assist in maintaining the desired direction of the drilled wellbore, and reamers to ensure that the drilled wellbore is maintained at a desired gauge (i.e., diameter).

In some applications, horizontal and other non-vertical or deviated wellbores are drilled (i.e., "directional drilling") to facilitate greater exposure to and production from larger regions of subsurface hydrocarbon-bearing formations than would be possible using only vertical wellbores. In directional drilling, specialized drillstring components and "bottomhole assemblies" (BHAs) may be used to induce, monitor, and control deviations in the path of the drill bit, so as to produce a wellbore of the desired deviated configuration. Directional drilling may be carried out using a downhole or mud motor provided in the BHA at the lower end of the drillstring immediately above the drill bit. Downhole mud motors may include several components, such as, for example (in order, starting from the top of the motor): (1) a power section including a stator and a rotor rotatably disposed in the stator; (2) a driveshaft assembly including a driveshaft disposed within a housing, with the upper end of the driveshaft being coupled to the lower end of the rotor; and (3) a bearing assembly positioned between the driveshaft assembly and the drill bit for supporting radial and thrust loads. For directional drilling, the motor may include a bent housing to provide an angle of deflection between the drill bit and the BHA.

SUMMARY

An embodiment of a downhole mud motor positionable in a wellbore comprises a driveshaft housing, a driveshaft rotatably disposed in the driveshaft housing, a bearing mandrel coupled to the driveshaft, wherein the bend adjustment assembly includes a first configuration that provides a first deflection angle between a longitudinal axis of the driveshaft housing and a longitudinal axis of the bearing mandrel, wherein the bend adjustment assembly includes a second configuration that provides a second deflection angle between the longitudinal axis of the driveshaft housing and the longitudinal axis of the bearing mandrel that is different from the first deflection angle, and wherein the bend adjustment assembly is configured to shift between the first configuration and the second configuration when positioned in the wellbore, and a locking assembly comprising a locked configuration configured to lock the bend adjustment assembly into one of the first configuration and the second configuration until the downhole mud motor has at least one of reached a predefined depth in the wellbore, and a mud weight has reached a predefined mud weight threshold at a given depth, in response to which the locking assembly is configured to actuate from the locked configuration to an unlocked configuration. In some embodiments, the locking assembly comprises a rupture disk configured to burst at a predefined pressure. In some embodiments, the locking assembly comprises a locking sleeve including a locked position and an unlocked position longitudinally spaced from the locked position, and wherein the locking sleeve is configured to shift from the locked position to the unlocked position in response to bursting of the rupture disk. In certain embodiments, the bend adjustment assembly comprises an offset housing and an adjustment mandrel having a first relative angular orientation associated with the first configuration and a second relative angular orientation associated with the second configuration. In certain embodiment, the locking assembly comprises a locking piston configured to lock the offset housing and the adjustment mandrel in the first relative angular orientation when in a first position. In some embodiments, the locking assembly comprises a first locking pin configured to lock the locking piston in the first position. In some embodiments, the locking assembly comprises a second locking pin configured to lock the locking piston in a second position configured to lock the offset housing and the adjustment mandrel in the second relative angular orientation. In certain embodiments, the adjustment mandrel and offset housing comprise interlocking castellations configured to lock the offset housing and adjustment mandrel in the first relative angular orientation. In certain embodiments, the adjustment mandrel has a first axial position wherein the interlocking castellations between the adjustment mandrel and offset housing are matingly engaged, and a second axial position wherein the interlocking castellations between the adjustment mandrel and offset housing are disengaged, and the adjustment mandrel shifts from the first axial position to the second axial position in response to the locking sleeve shifting from the locked to the unlocked position. In some embodiments, the adjustment mandrel is held in the first axial position by a shear pin, the locking assembly comprises a first locking pin configured to hold the locking piston axially separated from the adjustment mandrel when the locking sleeve is in the locked position, the locking pin is configured to release the locking piston into contact with the adjustment mandrel when the locking sleeve is in the unlocked position, and the locking piston is configured to apply force to the adjustment mandrel to fracture the shear pin and permit the adjustment mandrel to shift from the first axial position to the second axial position. In certain embodiments, the bend adjustment assembly can shift between the first relative angular orientation and second relative angular orientation when the adjustment mandrel has shifted into the second axial position. In certain embodiments, the locking assembly comprises a second locking pin configured to lock the locking piston in a second position configured to lock the offset housing and the adjustment mandrel in the second relative angular orientation. In some embodiments, the offset housing and the adjustment mandrel can shift between the first relative angular orientation and the second relative angular orientation up to an unlimited number of times. In some embodiments, the offset housing and the adjustment mandrel can shift between the second relative angular orientation and a third relative angular orientation up to an unlimited number of times. In some embodiments, the offset housing and adjustment mandrel have a third relative angular orientation associated with a third configuration. In certain embodiments, the second deflection angle is larger than the first deflection angle. In certain embodiments, the second deflection angle is less than the first deflection angle. In some embodiments, the actuator assembly is configured to shift the bend adjustment assembly between the first configuration and the second configuration in response to a change in at least one of flowrate of a drilling fluid supplied to the downhole mud motor, pressure of the drilling fluid supplied to the downhole mud motor, and relative rotation between the driveshaft housing and the bearing mandrel. In some embodiments, the bend adjustment assembly includes a third configuration providing a third deflection angle between the longitudinal axis of the driveshaft housing and the longitudinal axis of the bearing mandrel that is different from at least one of the first deflection angle and the second deflection angle.

An embodiment of a downhole mud motor positionable in a wellbore comprises a driveshaft housing, a driveshaft rotatably disposed in the driveshaft housing, a bearing mandrel coupled to the driveshaft, wherein the bend adjustment assembly includes a first configuration that provides a first deflection angle between a longitudinal axis of the driveshaft housing and a longitudinal axis of the bearing mandrel, wherein the bend adjustment assembly includes a second configuration that provides a second deflection angle between the longitudinal axis of the driveshaft housing and the longitudinal axis of the bearing mandrel that is different from the first deflection angle, an actuator assembly configured to shift the bend adjustment assembly between the first configuration and the second configuration when the mud motor is disposed in the wellbore, and a locking assembly configured to prevent the actuator assembly from shifting the bend adjustment assembly between the first configuration and the second configuration until the mud motor has at least one of reached a predefined depth in the wellbore, and a mud weight has reached a predefined mud weight threshold at a given depth. In some embodiments, the locking assembly comprises a rupture disk configured to burst at a predefined pressure. In some embodiments, the locking assembly comprises a locking sleeve including a locked position and an unlocked position longitudinally spaced from the locked position, and wherein the locking sleeve is configured to shift from the locked position to the unlocked position in response to bursting of the rupture disk. In certain embodiments, the bend adjustment assembly comprises an offset housing and an adjustment mandrel having a first relative angular orientation associated with the first configuration and a second relative angular orientation associated with the second configuration, and the locking assembly comprises a locking piston configured to lock the offset housing and the adjustment mandrel in the first relative angular orientation when in a first position. In certain embodiments, the locking assembly comprises a first locking pin configured to lock the locking piston in the first position. In some embodiments, the locking assembly comprises a second locking pin configured to lock the locking piston in a second position configured to lock the offset housing and the adjustment mandrel in the second relative angular orientation. In some embodiments, the actuator assembly is configured to shift the bend adjustment assembly between the first configuration and the second configuration in response to a change in at least one of flowrate of a drilling fluid supplied to the downhole mud motor, pressure of the drilling fluid supplied to the downhole mud motor, and relative rotation between the driveshaft housing and the bearing mandrel. In certain embodiments, the bend adjustment assembly includes a third configuration providing a third deflection angle between the longitudinal axis of the driveshaft housing and the longitudinal axis of the bearing mandrel that is different from at least one of the first deflection angle and the second deflection angle.

An embodiment of a method for forming a deviated wellbore using a downhole mud motor comprises (a) positioning a bend adjustment assembly of the downhole mud motor in the wellbore in a first configuration that provides a first deflection angle between a longitudinal axis of a driveshaft housing of the downhole mud motor and a longitudinal axis of a bearing mandrel of the downhole mud motor, (b) locking the bend adjustment assembly into the first configuration with a locking assembly of the bend adjustment assembly that is disposed in a locked configuration, (c) automatically shifting the locking assembly from the locked configuration to an unlocked configuration upon at least one of the mud motor reaching a predefined depth in the wellbore, and a mud weight has reached a predefined mud weight threshold at a given depth, and (d) with the downhole mud motor positioned in the wellbore and the locking assembly in the unlocked configuration, shifting the bend adjustment assembly from the first configuration to a second configuration that provides a second deflection angle between the longitudinal axis of the driveshaft housing and the longitudinal axis of the bearing mandrel, the second deflection angle being different from the first deflection angle. In some embodiments, (c) comprises (c1) bursting a rupture disk of the locking assembly, and (c2) longitudinally shifting a locking sleeve of the locking assembly from a locked position to an unlocked position. In some embodiments, (c) comprises (c3) laterally shifting a locking pin from a first lateral position to a second lateral position in response to longitudinally shifting the locking sleeve to the unlocked position. In certain embodiments, (c) comprises (c4) shifting a locking piston of the locking assembly from a locked position to an unlocked position in response to laterally shifting the locking pin to the unlocked position. In certain embodiments, (d) comprises (d1) pumping drilling fluid into the wellbore from the surface pump at a reduced flowrate that is less than the drilling flowrate for a first time period, and (d2) following the first time period, pumping drilling fluid in the wellbore from the surface pump at an increased flowrate that is different than the reduced flowrate for a second time period. In some embodiments, the method comprises (e) with the downhole mud motor positioned in the wellbore and the locking assembly in the unlocked configuration, shifting the bend adjustment assembly from the second configuration to the first configuration. In some embodiments, the method comprises (e) with the downhole mud motor positioned in the wellbore and the locking assembly in the unlocked configuration, shifting the bend adjustment assembly from the second configuration to a third configuration that provides a third deflection angle between the longitudinal axis of the driveshaft housing and the longitudinal axis of the bearing mandrel, the third deflection angle being different from at least one of the first deflection angle and the second deflection angle.

BRIEF DESCRIPTION OF THE DRAWINGS

For a detailed description of disclosed embodiments, reference will now be made to the accompanying drawings in which.

DETAILED DESCRIPTION

Figure 1:
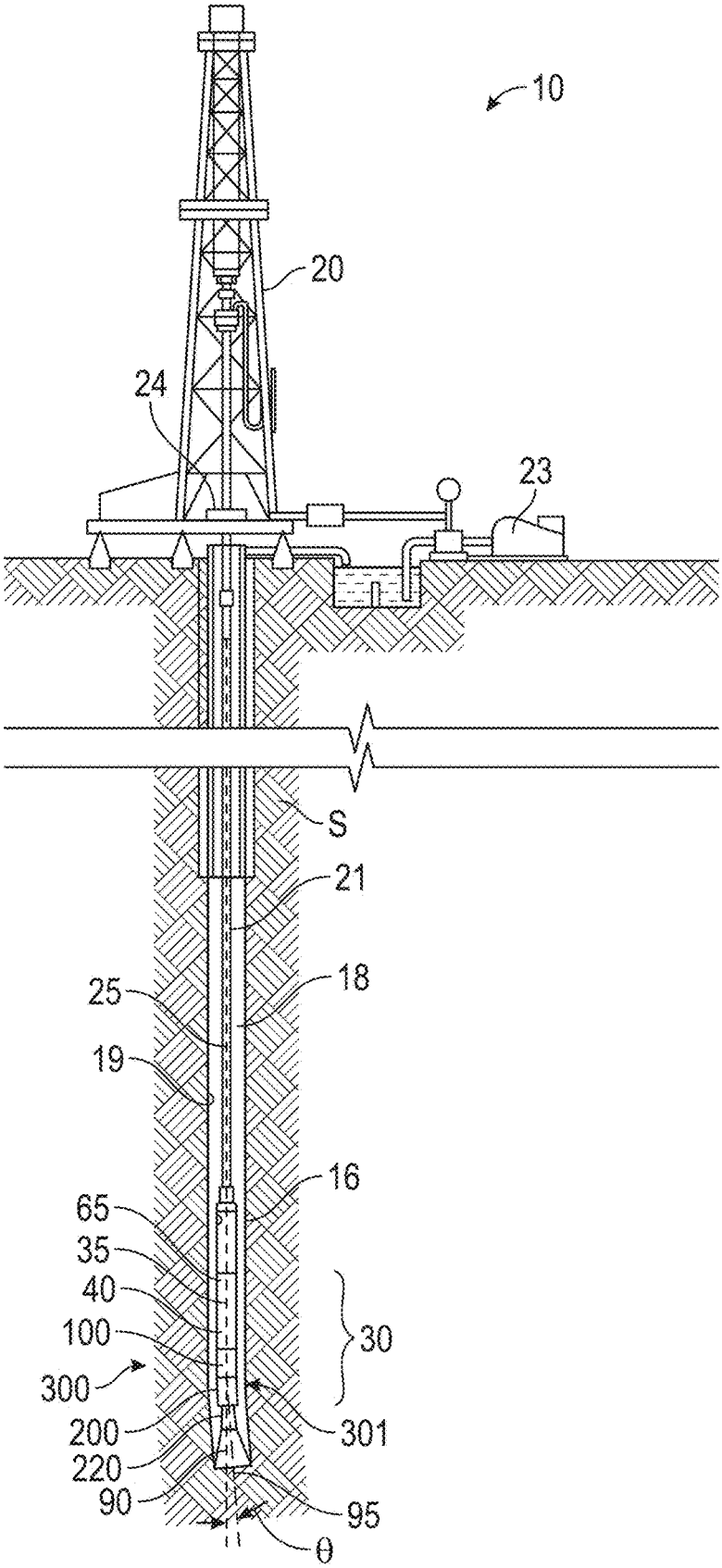
FIG. 1 is a schematic partial cross-sectional view of a drilling system including an embodiment of a downhole mud motor in accordance with principles disclosed herein.

The following discussion is directed to various embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection as accomplished via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the wellbore and with "down", "lower", "downwardly", "downhole", or "downstream" meaning toward the terminal end of the wellbore, regardless of the wellbore orientation.

As described above, downhole mud motors may include a bent housing for providing a deflection angle between the drill bit and the BHA. Conventionally, bent housings either provide a fixed deflection angle or an adjustable deflection angle that may only be adjustable at the surface. However, it may be desirable to adjust a deflection angle of the bent housing without needing to go through the lengthy process of pulling the BHA out of the wellbore so that the deflection angle may be adjusted.

Accordingly, embodiments of downhole-adjustable bend adjustment assemblies of downhole mud motors are described herein which may be adjusted in situ within the wellbore without needing to retrieve the downhole mud motor to the surface. Additionally, bend adjustment assemblies described herein include a locking assembly which only permits the bend adjustment assembly to adjust the deflection angle provided by the bend adjustment assembly once the downhole mud motor had reached a predefined depth in the wellbore. In this manner, the mud motor may be operated as desired (e.g., at different fluid flowrates, while providing rotation to the mud motor from the surface, etc.) without inadvertently actuating the bend adjustment assembly when it is not desired to do so. Additionally, locking assemblies of the bend adjustment assemblies described herein are configured to actuate automatically in response to reaching the predefined depth in the wellbore from a locked configuration locking the bend adjustment assembly into a given configuration and an unlocked configuration in which the bend adjustment assembly is permitted to actuate between a plurality of configurations providing a plurality of different deflection angles.

Referring to FIG. 1, an embodiment of a well system 10 is shown. Well system 10 is generally configured for drilling a wellbore 16 in an earthen formation 5. In this exemplary embodiment, well system 10 includes a drilling rig 20 disposed at the surface, a drillstring 21 extending downhole from rig 20, a bottomhole assembly (BHA) 30 coupled to the lower end of drillstring 21, and a drill bit 90 attached to the lower end of BHA 30. A surface or mud pump 23 is positioned at the surface and pumps drilling fluid or mud through drillstring 21. Additionally, rig 20 includes a rotary system 24 for imparting torque to an upper end of drillstring 21 to thereby rotate drillstring 21 in wellbore 16. In this exemplary embodiment, rotary system 24 comprises a rotary table located at a rig floor of rig 20; however, in other embodiments, rotary system 24 may comprise other systems for imparting rotary motion to drillstring 21, such as a top drive. A downhole mud motor 35 is provided in BHA 30 for facilitating the drilling of deviated portions of wellbore 16. Moving downward along BHA 30, motor 35 includes a hydraulic drive or power section 40, a driveshaft assembly 100, and a bearing assembly 200. In some embodiments, the portion of BHA 30 disposed between drillstring 21 and motor 35 can include other components, such as drill collars, measurement-while-drilling (MWD) tools, reamers, stabilizers and the like.

Power section 40 of BHA 30 converts the fluid pressure of the drilling fluid pumped downward through drillstring 21 into rotational torque for driving the rotation of drill bit 90. Driveshaft assembly 100 and bearing assembly 200 transfer the torque generated in power section 40 to bit 90. With force or weight applied to the drill bit 90, also referred to as weight-on-bit ("WOB"), the rotating drill bit 90 engages the earthen formation and proceeds to form wellbore 16 along a predetermined path toward a target zone. The drilling fluid or mud pumped down the drillstring 21 and through BHA 30 passes out of the face of drill bit 90 and back up the annulus 18 formed between drillstring 21 and the wall 19 of wellbore 16. The drilling fluid cools the bit 90, and flushes the cuttings away from the face of bit 90 and carries the cuttings to the surface.

Figure 2:
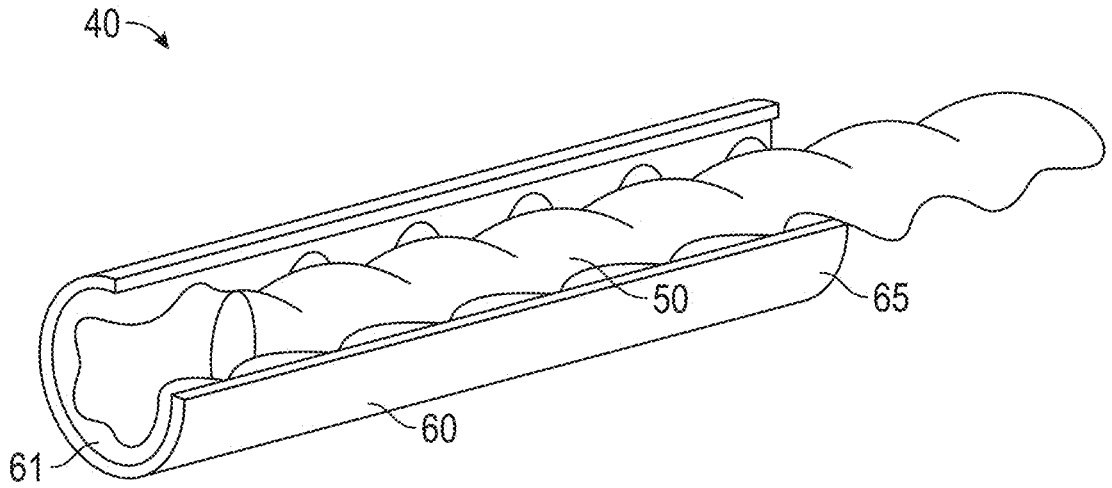
FIG. 2 is a perspective, partial cut-away view of the power section of FIG. 1.
Figure 3:
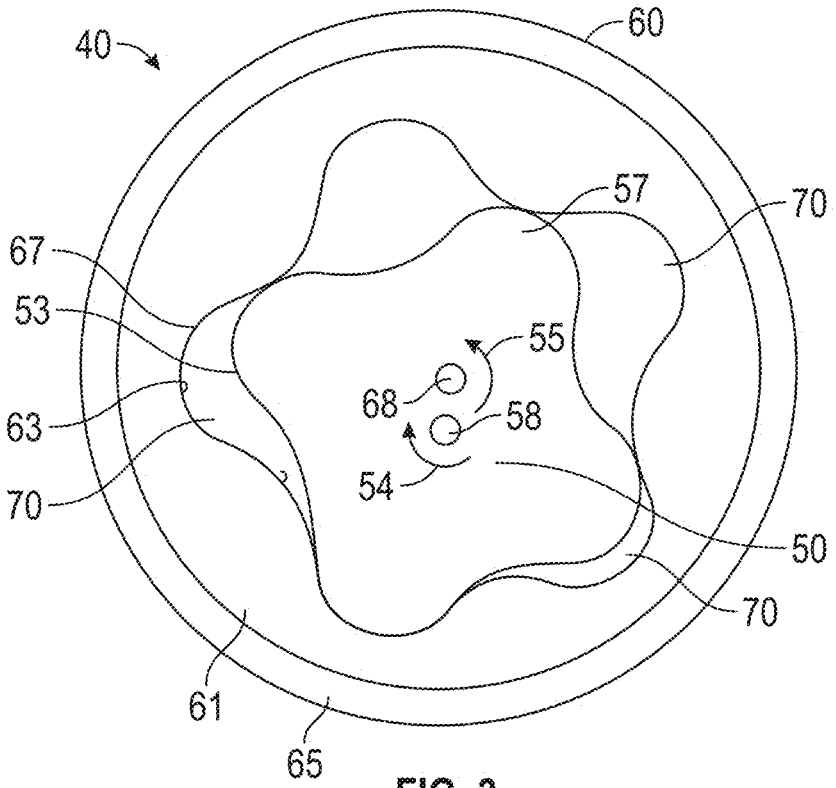
FIG. 3 is a cross-sectional end view of the power section of FIG. 1.
Figure 4:
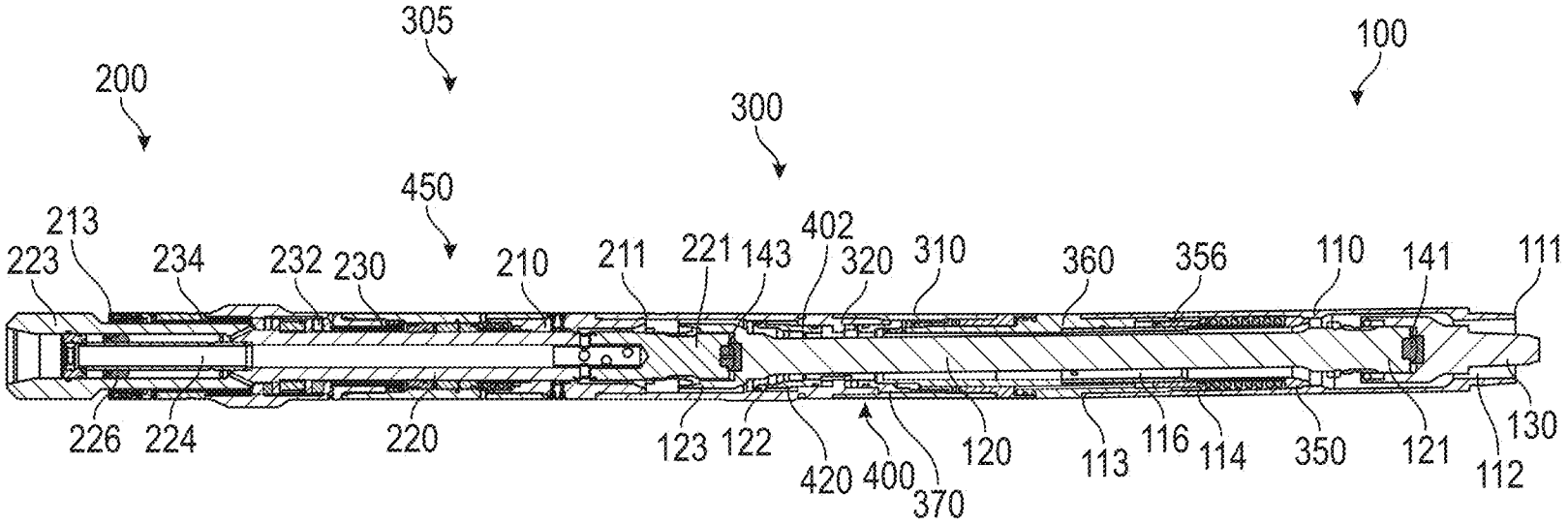
FIG. 4 is a cross-sectional side view of an embodiment of the mud motor of FIG. 1.

Referring to FIGS. 1-3, an embodiment of the power section 40 of BHA 30 is shown schematically in FIGS. 2 and 3. In this exemplary embodiment, power section 40 comprises a helical-shaped rotor 50 disposed within a stator 60 comprising a cylindrical stator housing 65 lined with a helical-shaped elastomeric insert 61. Helical-shaped rotor 50 defines a set of rotor lobes 57 that intermesh with a set of stator lobes 67 defined by the helical-shaped insert 61. As best shown in FIG. 3, the rotor 50 has one fewer lobe 57 than the stator 60. When the rotor 50 and the stator 60 are assembled, a series of cavities 70 are formed between the outer surface 53 of the rotor 50 and the inner surface 63 of the stator 60. Each cavity 70 is sealed from adjacent cavities 70 by seals formed along the contact lines between the rotor 50 and the stator 60. The central axis 58 of the rotor 50 is radially offset from the central axis 68 of the stator 60 by a fixed value known as the "eccentricity" of the rotor-stator assembly. Consequently, rotor 50 may be described as rotating eccentrically within stator 60.

During operation of the power section 40, fluid is pumped under pressure into one end of the power section 40 where it fills a first set of open cavities 70. A pressure differential across the adjacent cavities 70 forces the rotor 50 to rotate relative to the stator 60. As the rotor 50 rotates inside the stator 60, adjacent cavities 70 are opened and filled with fluid. As this rotation and filling process repeats in a continuous manner, the fluid flows progressively down the length of power section 40 and continues to drive the rotation of the rotor 50. Driveshaft assembly 100 shown in FIG. 1 includes a driveshaft discussed in more detail below that has an upper end coupled to the lower end of rotor 50. In this arrangement, the rotational motion and torque of rotor 50 is transferred to drill bit 90 via driveshaft assembly 100 and bearing assembly 200.

In this exemplary embodiment, driveshaft assembly 100 is coupled to bearing assembly 200 via a bend adjustment assembly 300 of BHA 30 that provides an adjustable bend 301 along motor 35. Due to bend 301, a deflection angle θ is formed between a central or longitudinal axis 95 (shown in FIG. 1) of drill bit 90 and the longitudinal axis 25 of drillstring 21. To drill a straight section of wellbore 16, drillstring 21 is rotated from rig 20 with a rotary table or top drive to rotate BHA 30 and drill bit 90 coupled thereto. Drillstring 21 and BHA 30 rotate about the longitudinal axis of drillstring 21, and thus, drill bit 90 is also forced to rotate about the longitudinal axis of drillstring 21. With bit 90 disposed at deflection angle θ, the lower end of drill bit 90 distal BHA 30 seeks to move in an arc about longitudinal axis 25 of drillstring 21 as it rotates, but is restricted by the sidewall 19 of wellbore 16, thereby imposing bending moments and associated stress on BHA 30 and mud motor 35.

In general, driveshaft assembly 100 functions to transfer torque from the eccentrically-rotating rotor 50 of power section 40 to a concentrically-rotating bearing mandrel 220 of bearing assembly 200 and drill bit 90. As best shown in FIG. 3, rotor 50 rotates about rotor axis 58 in the direction of arrow 54, and rotor axis 58 rotates about stator axis 68 in the direction of arrow 55. However, drill bit 90 and bearing mandrel 220 are coaxially aligned and rotate about a common axis that is offset and/or oriented at an acute angle relative to rotor axis 58. Thus, driveshaft assembly 100 converts the eccentric rotation of rotor 50 to the concentric rotation of bearing mandrel 220 and drill bit 90, which are radially offset and/or angularly skewed relative to rotor axis 58.

Referring to FIGS. 4-7, embodiments of driveshaft assembly 100, bearing assembly 200, and bend adjustment assembly 300 are shown. In this exemplary embodiment, driveshaft assembly 100 includes an outer or driveshaft housing 110 and a one-piece (i.e., unitary) driveshaft 120 rotatably disposed within housing 110. Housing 110 has a linear central or longitudinal axis 115, a first or upper end 111, a second or lower end 113 coupled to an outer or bearing housing 210 of bearing assembly 200 via bend adjustment assembly 300, and a central bore or passage 112 extending between ends 111 and 113. Particularly, an externally threaded connector or pin end of driveshaft housing 110 located at upper end 111 threadably engages a mating internally threaded connector or box end disposed at the lower end of stator housing 65, and an internally threaded connector or box end of driveshaft housing 110 located at lower end 113 threadably engages a mating externally threaded connector of bend adjustment assembly 300. Additionally, in this exemplary embodiment, driveshaft housing includes ports 114 that extend radially between the inner and outer surfaces of driveshaft housing 110.

Figure 21:
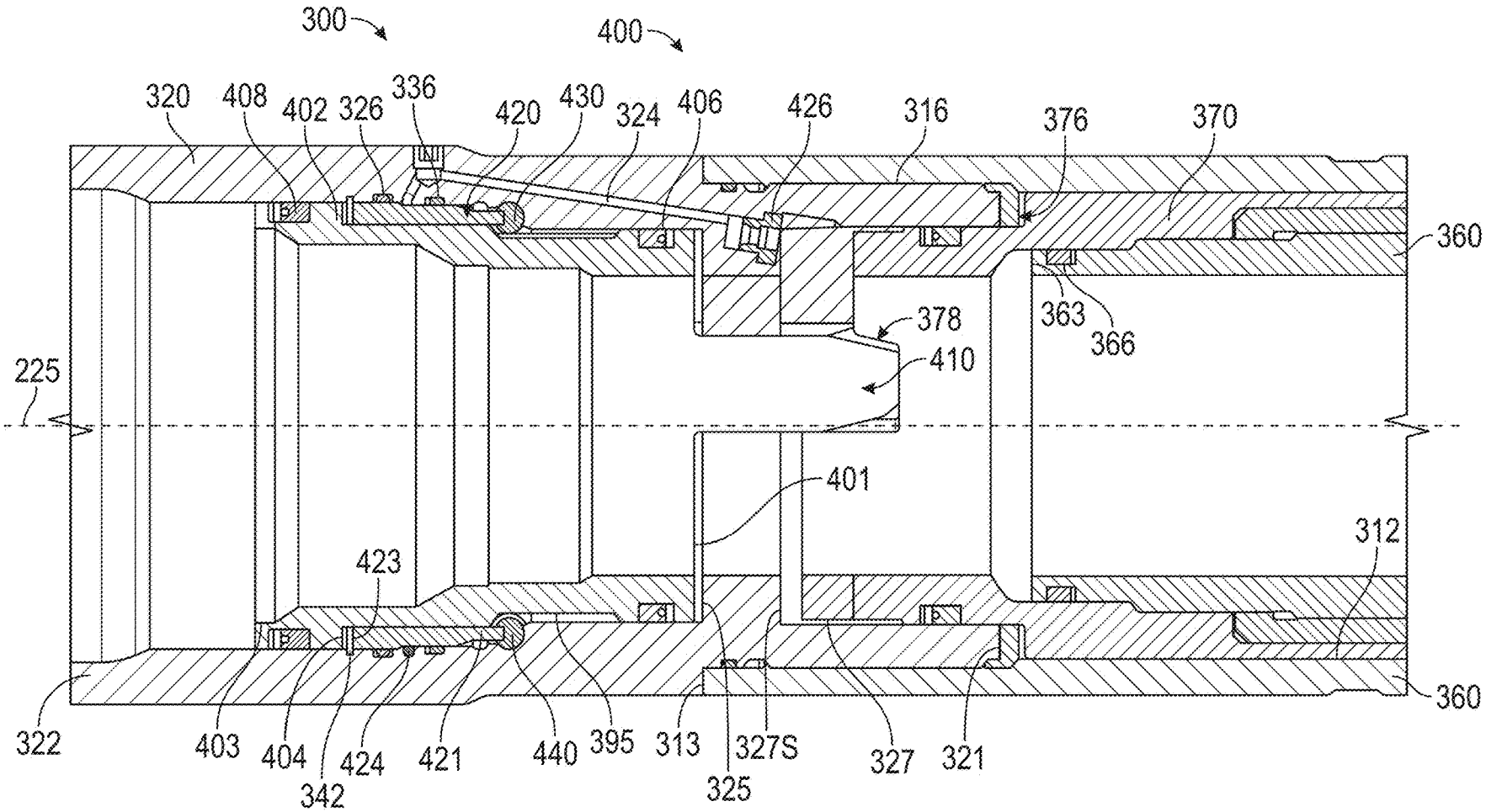
FIG. 21 is another zoomed-in cross-sectional side view of the bend adjustment assembly of FIG. 5.
Figure 22:
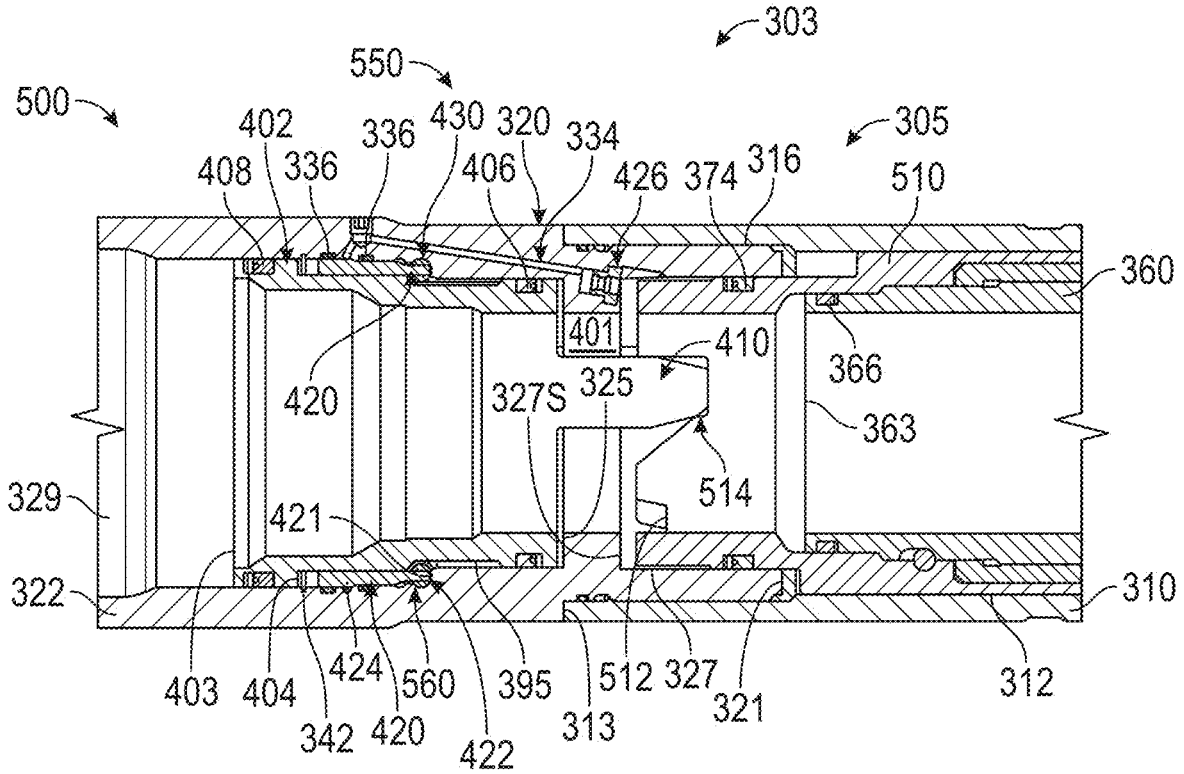
FIG. 22 is a cross-sectional side view of another embodiment of a bend adjustment assembly.
Figure 23:
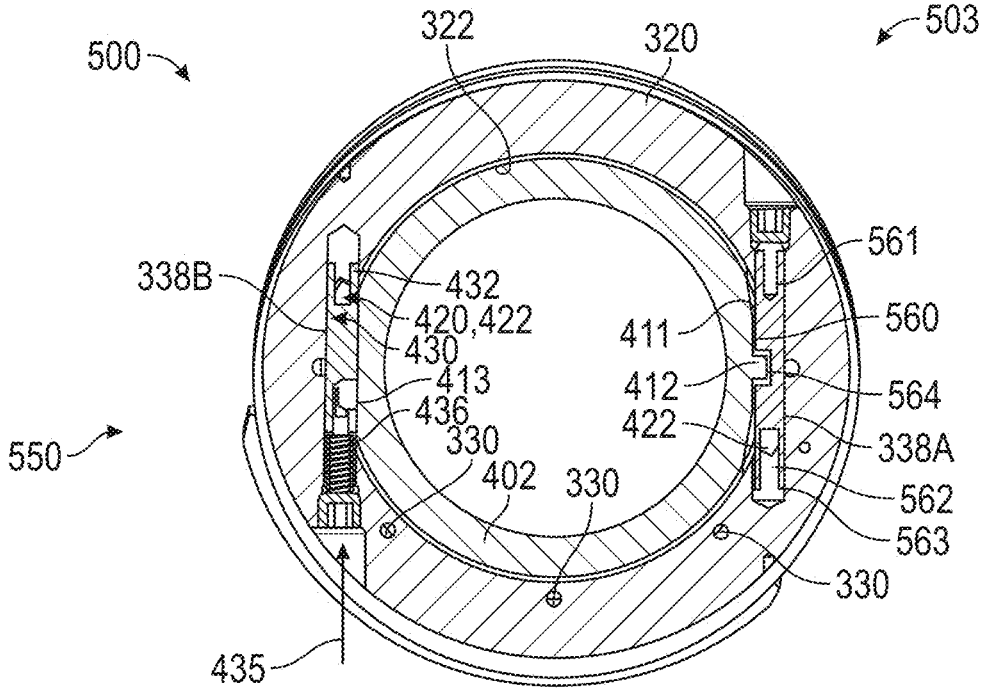
FIG. 23 is a cross-sectional end view of the bend adjustment assembly of FIG. 22.

In this exemplary embodiment, driveshaft housing 110 is coaxially aligned with stator housing 65. As will be discussed further herein, bend adjustment assembly 300 is configured to actuate between a first configuration 303 (shown in FIGS. 4, 5), and a second configuration 305 (shown in FIG. 21). In this exemplary embodiment, when bend adjustment assembly 300 is in the first configuration 303, driveshaft housing 110 is not disposed at an angle relative to bearing assembly 200 and drill bit 90. However, when bend adjustment assembly is disposed in the second configuration 305, bend 301 is formed between driveshaft assembly 100 and bearing assembly 200, orienting driveshaft housing 110 at deflection angle θ relative to bearing assembly 200 and drill bit 90. Additionally, as will be discussed further herein, bend adjustment assembly 300 is configured to actuate between the first and second configurations 303 and 305 in-situ with BHA 30 disposed in wellbore 16.

Driveshaft 120 of driveshaft assembly 100 has a linear central or longitudinal axis, a first or upper end 121, and a second or lower end 123 opposite end 121. Upper end 121 is pivotally coupled to the lower end of rotor 50 with a driveshaft adapter 130 and a first or upper universal joint 141, and lower end 123 is pivotally coupled to an upper end 221 of bearing mandrel 220 with a second or lower universal joint 143. In this exemplary embodiment, upper end 121 of driveshaft 120 and upper universal joint 141 are disposed within driveshaft adapter 130, whereas lower end 123 of driveshaft 120 comprises an axially extending counterbore or receptacle that receives upper end 221 of bearing mandrel 220 and lower universal joint 143. In this exemplary embodiment, driveshaft 120 includes a radially outwards extending shoulder 122 located proximal lower end 123.

In this exemplary embodiment, driveshaft adapter 130 extends along a central or longitudinal axis 135 between a first or upper end coupled to rotor 50, and a second or lower end coupled to the upper end 121 of driveshaft 120. In this exemplary embodiment, the upper end of driveshaft adapter 130 comprises an externally threaded male pin or pin end that threadably engages a mating female box or box end at the lower end of rotor 50. A receptacle or counterbore extends axially (relative to axis 135) from the lower end of adapter 130. The upper end 121 of driveshaft 120 is disposed within the counterbore of driveshaft adapter 130 and pivotally couples to adapter 130 via the upper universal joint 141 disposed within the counterbore of driveshaft adapter 130.

Universal joints 141 and 143 allow ends 121 and 123 of driveshaft 120 to pivot relative to adapter 130 and bearing mandrel 220, respectively, while transmitting rotational torque between rotor 50 and bearing mandrel 220. Driveshaft adapter 130 is coaxially aligned with rotor 50. Since rotor axis 58 is radially offset and/or oriented at an acute angle relative to the central axis of bearing mandrel 220, the central axis of driveshaft 120 is skewed or oriented at an acute angle relative to axis 115 of housing 110, axis 58 of rotor 50, and a central or longitudinal axis 225 of bearing mandrel 220. However, universal joints 141 and 143 accommodate for the angularly skewed driveshaft 120, while simultaneously permitting rotation of the driveshaft 120 within driveshaft housing 110.

In general, each universal joint (e.g., each universal joint 141 and 143) may comprise any joint or coupling that allows two parts that are coupled together and not coaxially aligned with each other (e.g., driveshaft 120 and adapter 130 oriented at an acute angle relative to each other) limited freedom of movement in any direction while transmitting rotary motion and torque including, without limitation, universal joints (Cardan joints, Hardy-Spicer joints, Hooke joints, etc.), constant velocity joints, or any other custom designed joint. In other embodiments, driveshaft assembly 100 may include a flexible shaft comprising a flexible material (e.g., Titanium, etc.) that is directly coupled (e.g., threadably coupled) to rotor 50 of power section 40 in lieu of driveshaft 120, where physical deflection of the flexible shaft (the flexible shaft may have a greater length relative driveshaft 120) accommodates axial misalignment between driveshaft assembly 100 and bearing assembly 200 while allowing for the transfer of torque therebetween.

As previously described, adapter 130 couples driveshaft 120 to the lower end of rotor 50. During drilling operations, high pressure drilling fluid or mud is pumped under pressure down drillstring 21 and through cavities 70 between rotor 50 and stator 60, causing rotor 50 to rotate relative to stator 60. Rotation of rotor 50 drives the rotation of driveshaft adapter 130, driveshaft 120, bearing assembly mandrel 220, and drill bit 90. The drilling fluid flowing down drillstring 21 through power section 40 also flows through driveshaft assembly 100 and bearing assembly 200 to drill bit 90, where the drilling fluid flows through nozzles in the face of bit 90 into annulus 18. Within driveshaft assembly 100 and the upper portion of bearing assembly 200, the drilling fluid flows through an annulus 116 formed between driveshaft housing 110 and driveshaft 120.

Still referring to FIGS. 4-7, bearing assembly 200 includes bearing housing 210 and one-piece (i.e., unitary) bearing mandrel 220 rotatably disposed within housing 210. Bearing housing 210 has a linear central or longitudinal axis disposed coaxial with central axis 225 of mandrel 220, a first or upper end 211 coupled to lower end 113 of driveshaft housing 110 via bend adjustment assembly 300, a second or lower end 213, and a central through bore or passage extending axially between ends 211 and 213. Particularly, the upper end 211 comprises an externally threaded connector or pin end coupled with bend adjustment assembly 300. Bearing housing 210 is coaxially aligned with bit 90, however, due to bend 301 between driveshaft assembly 100 and bearing assembly 200, bearing housing 210 is oriented at deflection angle θ relative to driveshaft housing 110. In this exemplary embodiment, bearing housing 210 comprises a plurality of separate tubular housings connected end-to-end; however, it may be understood that in other embodiments, bearing housing 210 may comprise a single, integrally or monolithically formed housing.

In this exemplary embodiment, bearing mandrel 220 of bearing assembly 200 has a first or upper end 221, a second or lower end 223, and a central through passage 222 extending axially from lower end 223 and terminating axially below upper end 221. The upper end 221 of bearing mandrel 220 is directly coupled to the lower end 123 of driveshaft 120 via lower universal joint 143. In particular, upper end 221 is disposed within a receptacle formed in the lower end 123 of driveshaft 120 and pivotally coupled thereto with lower universal joint 143. Additionally, the lower end 223 of mandrel 220 is coupled to drill bit 90.

In this exemplary embodiment, bearing mandrel 220 includes a plurality of drilling fluid ports 227 extending radially from passage 222 to the outer surface of mandrel 220, and a plurality of lubrication ports 229 also extending radially to the outer surface of mandrel 220, where drilling fluid ports 227 are disposed proximal an upper end of passage 222 and lubrication ports 229 are axially spaced from drilling fluid ports 227. In this arrangement, lubrication ports 229 are separated or sealed from passage 222 of bearing mandrel 220 and the drilling fluid flowing through passage 222. Drilling fluid ports 227 provide fluid communication between annulus 116 and passage 222. During drilling operations, mandrel 220 is rotated about axis 225 relative to housing 210. In particular, high pressure drilling fluid is pumped through power section 40 to drive the rotation of rotor 50, which in turn drives the rotation of driveshaft 120, mandrel 220, and drill bit 90. The drilling mud flowing through power section 40 flows through annulus 116, drilling fluid ports 227 and passage 222 of mandrel 220 in route to drill bit 90.

In this exemplary embodiment, the upper end 121 of driveshaft 120 is coupled to rotor 50 with a driveshaft adapter 130 and upper universal joint 141, and the lower end 123 of driveshaft 120 is coupled to the upper end 221 of bearing mandrel 220 with lower universal joint 143. As shown particularly in FIG. 7, bearing housing 210 has a central bore or passage defined by a radially inner surface 212 that extends between ends 211 and 213. One or more upper annular seals 214 are disposed in the inner surface 212 of housing 210 proximal upper end 211 while a second or lower annular seal 216 is disposed in the inner surface 212 proximal lower end 213. In this arrangement, an annular chamber 217 is formed radially between inner surface 212 and an outer surface of bearing mandrel 220, where annular chamber 217 extends axially between upper seals 214 and lower seal 216. In this exemplary embodiment, the inner surface 212 of bearing housing 210 additionally includes an annular seal 215 located proximal an annular shoulder 218 of the inner surface 212. Bearing housing 210 further includes one or more radial ports 219 in this exemplary embodiment.

Additionally, in this exemplary embodiment, bearing mandrel 220 includes a central sleeve 224 disposed in passage 222 and coupled to an inner surface of mandrel 220 defining passage 222. An annular piston 226 is slidably disposed in passage 222 radially between the inner surface of mandrel 220 and an outer surface of sleeve 224, where piston 226 includes a first or outer annular seal that seals against the inner surface of mandrel 220 and a second or inner annular seal that seals against the outer surface of sleeve 224. In this arrangement, chamber 217 extends into the annular space (via lubrication ports 229) formed between the inner surface of mandrel 220 and the outer surface of sleeve 224 that is sealed from the flow of drilling fluid through passage 222 via the annular seals of piston 226.

In this exemplary embodiment, a first or upper radial bearing 230, a thrust bearing assembly 232, and a second or lower radial bearing 234 are each disposed in chamber 217. Upper radial bearing 230 is disposed about mandrel 220 and axially positioned above thrust bearing assembly 232, and lower radial bearing 234 is disposed about mandrel 220 and axially positioned below thrust bearing assembly 232. In general, radial bearings 230, 234 permit rotation of mandrel 220 relative to housing 210 while simultaneously supporting radial forces therebetween. In this exemplary embodiment, upper radial bearing 230 and lower radial bearing 234 are both sleeve type bearings that slidingly engage the outer surface of mandrel 220. However, in general, any suitable type of radial bearing(s) may be employed including, without limitation, needle-type roller bearings, radial ball bearings, PDC Diamond tiled bearings, and/or combinations thereof.

Annular thrust bearing assembly 232 is disposed about mandrel 220 and permits rotation of mandrel 220 relative to housing 210 while simultaneously supporting axial loads in both directions (e.g., off-bottom and on-bottom axial loads). In this exemplary embodiment, thrust bearing assembly 232 generally comprises a pair of caged roller bearings and corresponding races, with the central race coupled to bearing mandrel 220. In other embodiments, one or more other types of thrust bearings may be included in bearing assembly 200, including ball bearings, planar bearings, PDC Diamond insert bearings etc. In still other embodiments, the thrust bearing assemblies of bearing assembly 200 may be disposed in the same or different thrust bearing chambers (e.g., two-shoulder or four-shoulder thrust bearing chambers). In this exemplary embodiment, radial bearings 230, 234 and thrust bearing assembly 232 are oil-sealed bearings. Particularly, chamber 217 comprises an oil or lubricant filled chamber that is pressure compensated via piston 226. In other words, piston 226 equalizes the fluid pressure within chamber 217 with the pressure of drilling fluid flowing through passage 222 of mandrel 220 towards drill bit 90. As previously described, in this exemplary embodiment, bearings 230, 232, 234 are oil-sealed. However, in other embodiments, the bearings of the bearing assembly (e.g., bearing assembly 200) are mud lubricated.

Referring still to FIGS. 4-7, as previously described, bend adjustment assembly 300 couples driveshaft housing 110 to bearing housing 210, and introduces bend 301 and deflection angle $\theta$ along motor 35. Central axis 115 of driveshaft housing 110 is coaxially aligned with axis 25, and central axis 225 of bearing mandrel 220 is coaxially aligned with axis 95, thus, deflection angle $\theta$ also represents the angle between axes 115, 225 when mud motor 35 is in an undeflected state (e.g., outside wellbore 16). Bend adjustment assembly 300 is configured to adjust the deflection angle $\theta$ between a first predetermined deflection angle $\theta_1$ and a second predetermined deflection angle $\theta_2$, different from the first deflection angle $\theta_1$, with drillstring 21 and BHA 30 in-situ disposed in wellbore 16. In other words, bend adjustment assembly 300 is configured to adjust the amount of bend 301 without needing to pull drillstring 21 from wellbore 16 to adjust bend adjustment assembly 300 at the surface, thereby reducing the amount of time required to drill wellbore 16. In this exemplary embodiment, first predetermined deflection angle $\theta_1$ is substantially equal to 0° while second deflection angle $\theta_2$ is an angle greater than 0°, such as an angle between 0°-5°; however, in other embodiments, first deflection angle $\theta_1$ may be greater than 0°, as will be discussed further herein.

In this exemplary embodiment, bend adjustment assembly 300 generally includes a first or upper housing 310, a second or lower housing 320, a piston mandrel 350, a first or upper adjustment mandrel 360, a second or lower adjustment mandrel 370, and a locking assembly 400. Additionally, in this exemplary embodiment, bend adjustment assembly 300 includes an actuator assembly 450 housed in bearing housing 210, where actuator assembly 450 is generally configured to control the actuation of bend adjustment assembly between the first deflection angle $\theta_1$ and the second deflection angle $\theta_2$ with BHA 30 disposed in wellbore 16. Upper housing 310 and lower housing 320 may be referred to at times as offset housings 310, 320. Additionally, in this exemplary embodiment, upper housing 310 comprises a plurality of tubular housings connected end-to-end; however, it may be understood that in other embodiments, upper housing 310 may comprise a singular integrally or monolithically formed housing.

Referring now to FIGS. 5, 6, and 8-11, components of the bend adjustment assembly 300 are shown. As shown particularly in FIG. 6, upper housing 310 is generally tubular and has a first or upper end 311, a second or lower end 313, and a central bore or passage defined by a generally cylindrical inner surface 312 extending between ends 311 and 313. The inner surface 312 of upper housing 310 includes an engagement surface 314 extending from upper end 311 and a threaded connector 316 extending from lower end 313. An annular seal 318 is disposed radially between engagement surface 314 of upper housing 310 and an outer surface of upper adjustment mandrel to seal the annular interface formed therebetween.

Lower housing 320 of bend adjustment assembly 300 is generally tubular and has a first or upper end 319, a second or lower end 321, and a generally cylindrical inner surface 322 extending between ends 319 and 321. A generally cylindrical outer surface of lower housing 320 includes a threaded connector coupled to the threaded connector 316 of upper housing 310. The inner surface 322 of lower housing 320 includes an offset engagement surface 323 extending from upper end 319 to an internal shoulder 327S, and a threaded connector 324 extending from lower end 321. In this exemplary embodiment, offset engagement surface 323 defines an offset bore or passage 327 that extends between upper end 319 and internal shoulder 327S of lower housing 320.

Additionally, lower housing 320 includes a central bore or passage 329 extending between lower end 321 and internal shoulder 327S, where central bore 329 has a central axis disposed at an angle relative to a central axis of offset bore 327. In other words, offset engagement surface 323 has a central or longitudinal axis that is offset or disposed at an angle relative to a central or longitudinal axis of lower housing 320. Thus, in this exemplary embodiment, the offset or angle formed between central bore 329 and offset bore 327 of lower housing 320 facilitates the formation of bend 301 described above. In this exemplary embodiment, the inner surface 322 of lower housing 320 additionally includes a first or upper annular shoulder 325, and a second or lower annular shoulder 326. Additionally, inner surface 322 of lower housing 320 includes a pair of circumferentially spaced slots 331, where slots 331 extend axially into lower housing 320 from upper shoulder 325.

In this exemplary embodiment, lower housing 320 of bend adjustment assembly 300 includes an arcuate lip or extension 328 at upper end 319. Particularly, extension 328 extends arcuately between a pair of axially extending shoulders 328S. In this exemplary embodiment, extension 328 extends less than 180° about the central axis of lower housing 320; however, in other embodiments, the arcuate length or extension of extension 328 may vary. Additionally, in this exemplary embodiment, a plurality of circumferentially spaced teeth or castellations 333 are formed on the extension 328. Further, in this exemplary embodiment, lower housing 320 includes a plurality of circumferentially spaced and axially extending ports 330. Particularly, ports 330 extend axially between lower shoulder 326 and an arcuate shoulder 332 from which extension 328 extends. As will be discussed further herein, ports 330 of lower housing 320 provide fluid communication through a generally annular compensation or locking chamber 395 of bend adjustment assembly 300.

Figure 5:
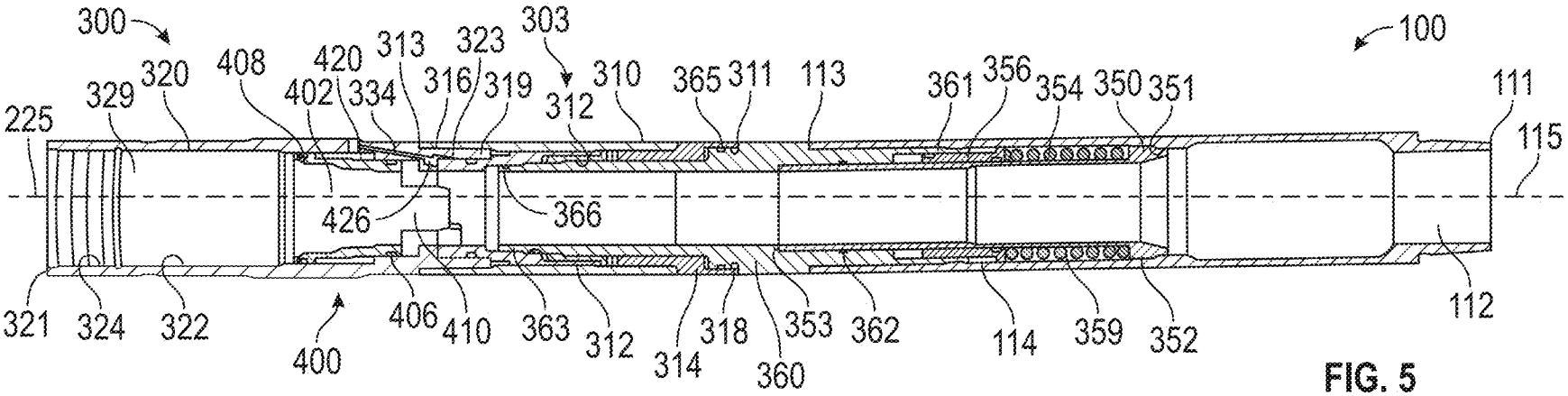
FIG. 5 is a cross-sectional side view of an embodiment of a bend adjustment assembly of the downhole mud motor of FIG. 4.
Figure 6:
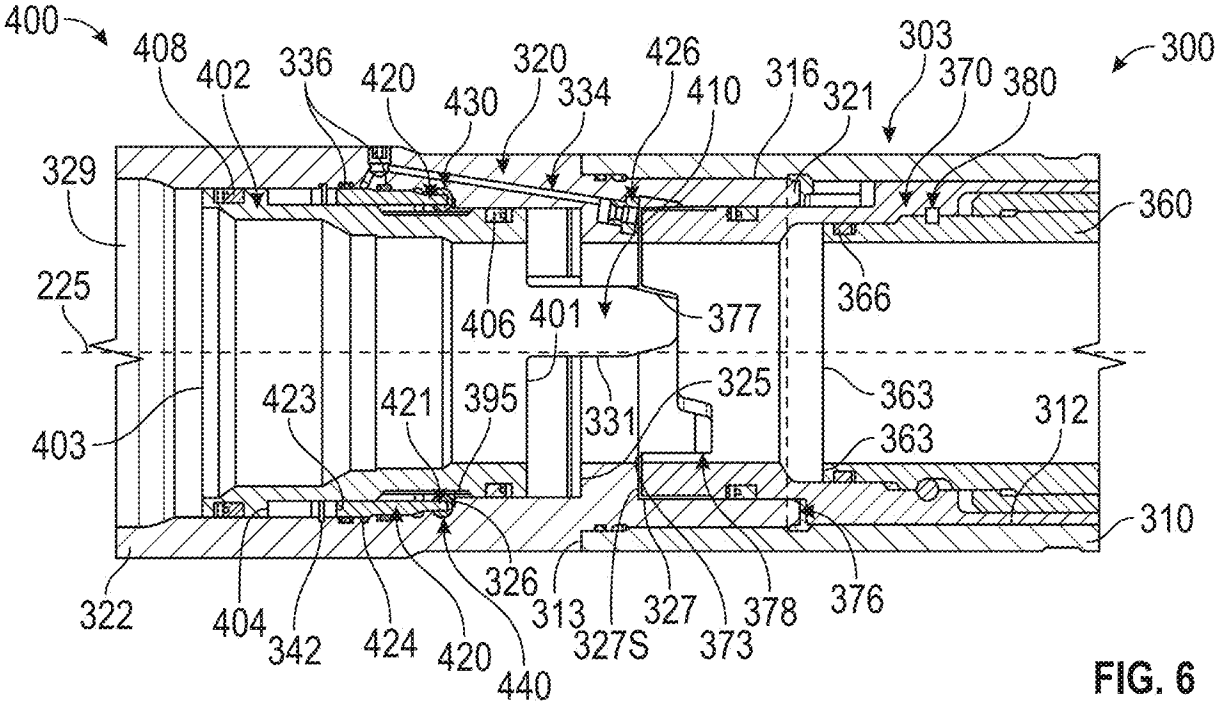
FIG. 6 is a zoomed-in cross-sectional side view of the bend adjustment assembly of FIG. 5.

As shown particularly in FIG. 5, piston mandrel 350 of bend adjustment assembly 300 is generally tubular and has a first or upper end 351, a second or lower end 353, and a central bore or passage extending between ends 351 and 353. Additionally, in this exemplary embodiment, piston mandrel 350 includes a generally an annular seal 352 positioned on an outer surface thereof proximal upper end 351 and which sealingly engages the inner surface of driveshaft housing 110. Further, piston mandrel 350 includes an annular shoulder located proximal upper end 351 that physically engages or contacts an annular biasing member 354 extending about the outer surface of piston mandrel 350. In this exemplary embodiment, an annular compensating piston 356 is slidably disposed about the outer surface of piston mandrel 350. In some embodiments, compensating piston 356 may include a pair of annular seals which sealingly engage the inner surface of driveshaft housing 110 and the outer surface of piston mandrel 350.

The upper adjustment mandrel 360 of bend adjustment assembly 300 is generally tubular and has a first or upper end 361, a second or lower end 363, and a central bore or passage defined by a generally cylindrical inner surface extending between ends 361 and 363. In this exemplary embodiment, the inner surface of upper adjustment mandrel 360 includes an annular recess extending axially into mandrel 360 from upper end 361, and an annular seal 362 axially spaced from recess 361 and which sealingly engages the outer surface of piston mandrel 350. Adjustment mandrel 360 is connected with piston mandrel 350 to restrict relative movement therebetween. In this exemplary embodiment, an outer seal of compensating piston 356 sealingly engages the inner surface of upper adjustment mandrel 360, restricting fluid communication between locking chamber 395 and a generally annular compensating chamber 359 formed about piston mandrel 350 and extending axially between seal 352 of piston mandrel 350 and outer seal of compensating piston 356. In this configuration, compensating chamber 359 is in fluid communication with the surrounding environment (e.g., wellbore 16) via ports 114 in driveshaft housing 110.

In this exemplary embodiment, upper adjustment mandrel 360 includes a generally cylindrical outer surface comprising a first or upper threaded connector, an offset engagement surface 365, and a second or lower threaded connector. The upper threaded connector of upper adjustment mandrel 360 extends from upper end 361 and couples to a threaded connector disposed on the inner surface of driveshaft housing 110 at lower end 113. Offset engagement surface 365 has a central or longitudinal axis that is offset from or disposed at an angle relative to a central or longitudinal axis of upper adjustment mandrel 360. Offset engagement surface 365 matingly engages the engagement surface 314 of upper housing 310, as will be described further herein. In this exemplary embodiment, relative rotation is permitted between upper housing 310 and upper adjustment mandrel 360 while relative axial movement is restricted between housing 310 and mandrel 360. Adjustment mandrel 360 is connected with lower adjustment mandrel 370 to restrict relative movement therebetween. Further, the outer surface of upper offset mandrel 360 proximal the lower end 363 thereof includes an annular seal 366 located proximal lower end 363 that sealingly engages lower adjustment mandrel 370.

Referring still to FIGS. 5, 6, and 8-10, lower adjustment mandrel 370 of bend adjustment assembly 300 is generally tubular and has a first or upper end 371, a second or lower end 373, and a central bore or passage extending therebetween that is defined by a generally cylindrical inner surface. In this exemplary embodiment, the inner surface of lower adjustment mandrel 370 includes axial slots which engage axial splines of upper adjustment mandrel 360. Additionally, in this exemplary embodiment, lower adjustment mandrel 370 includes a generally cylindrical outer surface comprising an offset engagement surface 372. Offset engagement surface 372 has a central or longitudinal axis that is offset or disposed at an angle relative to a central or longitudinal axis of the upper end 361 of upper adjustment mandrel 360 and the lower end 321 of lower housing 320, where offset engagement surface 372 is disposed directly adjacent or overlaps the offset engagement surface 323 of lower housing 320. When bend adjustment assembly 300 is disposed in the first configuration 303, a first deflection angle is provided between the central axis of lower housing 320 and the central axis of upper adjustment mandrel 360, and when bend adjustment assembly 300 is disposed in the second configuration 305, a second deflection angle is provided between the central axis of lower housing 320 and the central axis of upper adjustment mandrel 360 that is different from the first deflection angle.

In this exemplary embodiment, an annular seal 374 is disposed in the outer surface of lower adjustment mandrel 370 to sealingly engage the inner surface of lower housing 320. In this exemplary embodiment, a recess 379 is formed on the outer surface of lower adjustment mandrel 370 which extends arcuately between a pair of circumferentially spaced shoulders 375. Additionally, a plurality of circumferentially spaced teeth or castellations 376 are formed in the arcuate recess 379 between shoulders 375. In this exemplary embodiment, lower adjustment mandrel 370 further includes a pair of circumferentially spaced first or short slots 377 and a pair of circumferentially spaced second or long slots 378. Both the short slots 377 and long slots 378 of lower adjustment mandrel 370 extend axially into lower adjustment mandrel 370 from the lower end 373 thereof. In this exemplary embodiment, each short slot 377 is circumferentially spaced approximately 180° apart. Similarly, in this exemplary embodiment, each long slot 378 is circumferentially spaced approximately 180° apart.

Figure 10:
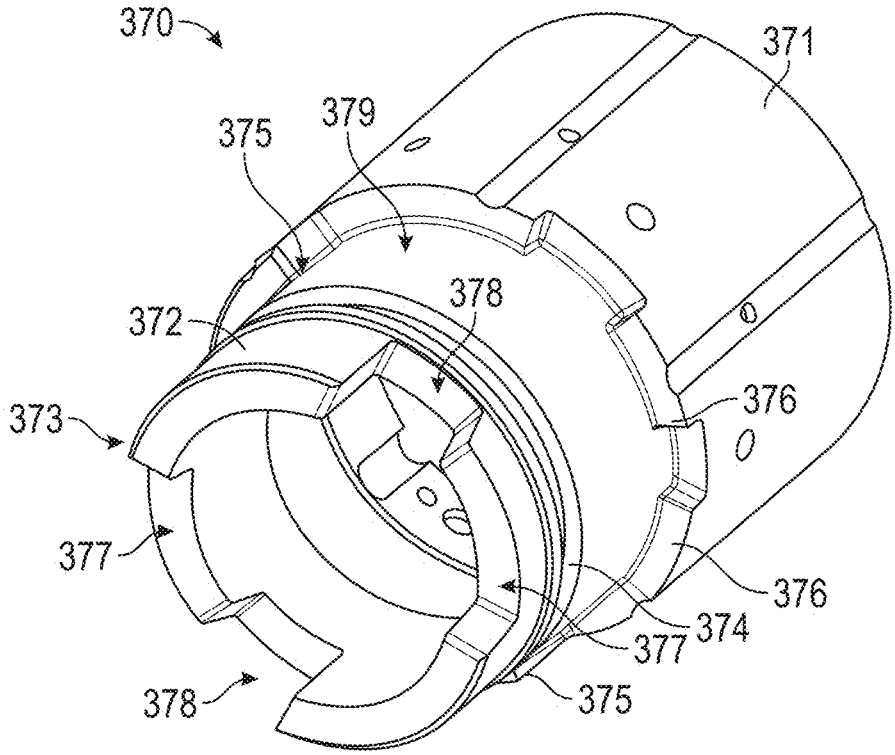
FIG. 10 is a perspective views of an embodiment of an adjustment mandrel of the bend adjustment assembly of FIG. 5.

FIG. 10 illustrates the short slots 377 and long slots 378 directly adjacent each with no rib of material or other obstruction interposed therebetween thereby permitting a single shift from the first configuration 303 to the second configuration 305 of bend adjustment assembly 300. However, it may be understood that other applications may require multiple shifts during the run, as will be described further herein with respect to FIG. 11, which permits the use of a lower adjustment mandrel 390 with slots 377 and 378 circumferentially spaced such that a rib of material is present between the adjacent slots of the lower adjustment mandrel.

In this exemplary embodiment, lower adjustment mandrel 370 is initially coupled to upper adjustment mandrel 360 by a shear member or pin 380 positioned radially therebetween which restricts relative axial movement between adjustment mandrels 360, 370. As will be described further herein, shear pin 380 may be sheared during the operation of bend adjustment assembly 300 to permit relative axial movement between adjustment mandrels 360, 370. Additionally, one or more splines or keys are positioned radially between adjustment mandrels 360, 370 to restrict relative rotation therebetween.

Figure 11:
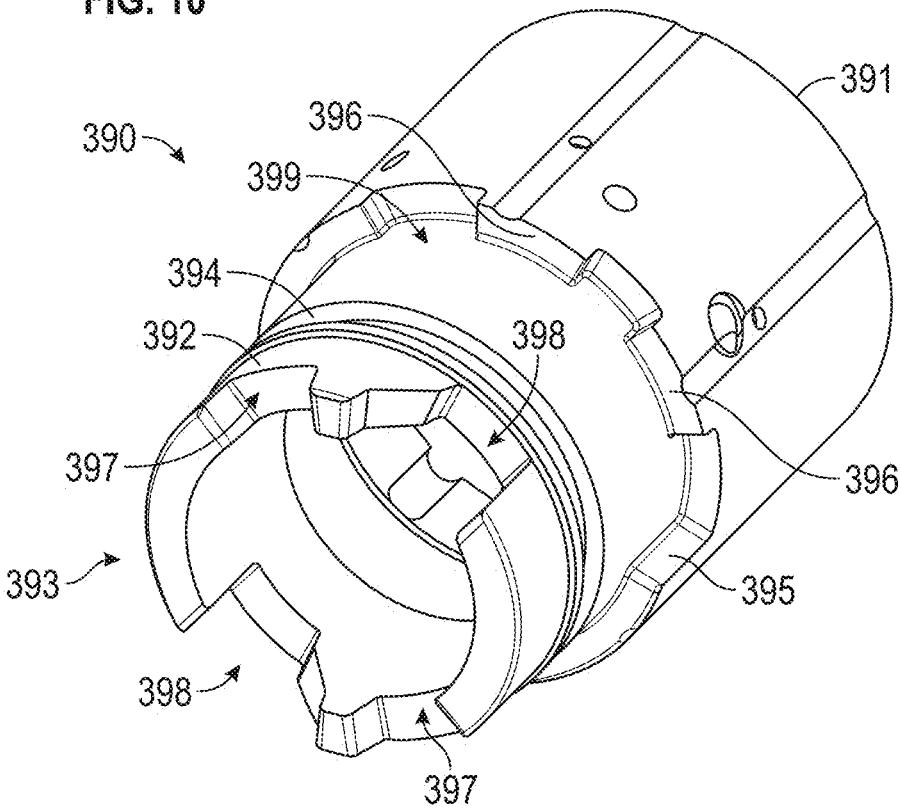
FIG. 11 is a perspective view of another embodiment of an adjustment mandrel.
Figure 12:
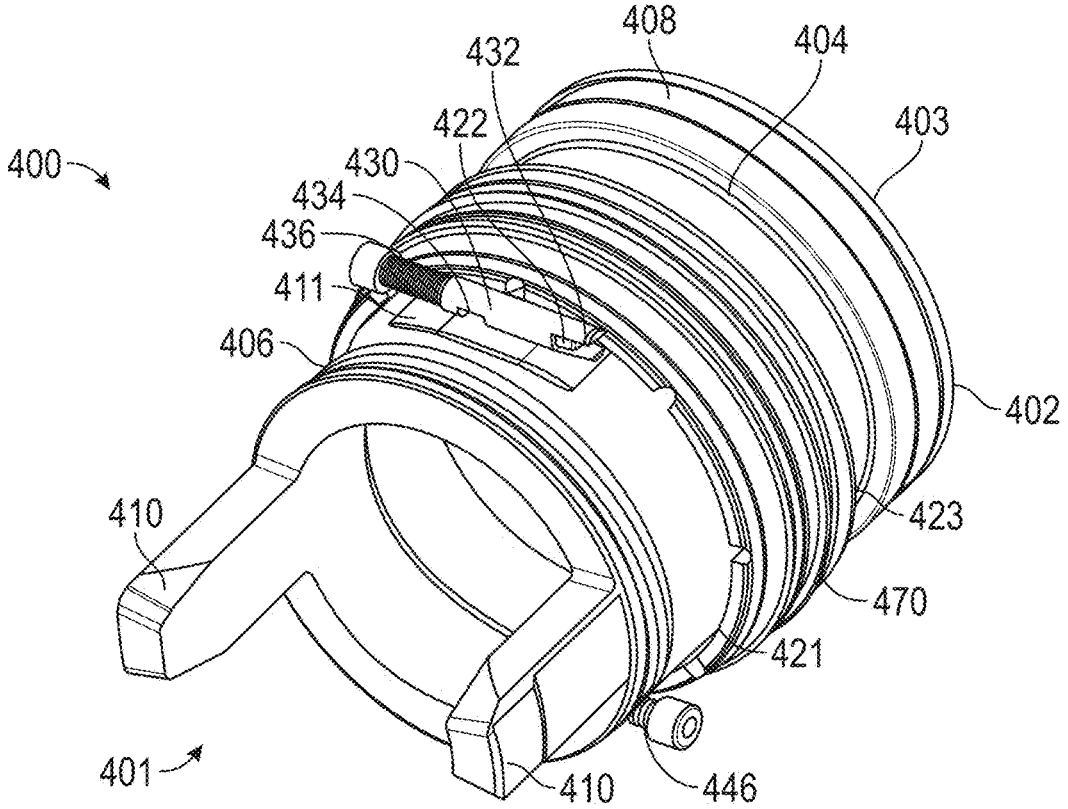
FIGS. 12, 13 are perspective views of an embodiment of a locking assembly of the bend adjustment assembly of FIG. 5.
Figure 13:
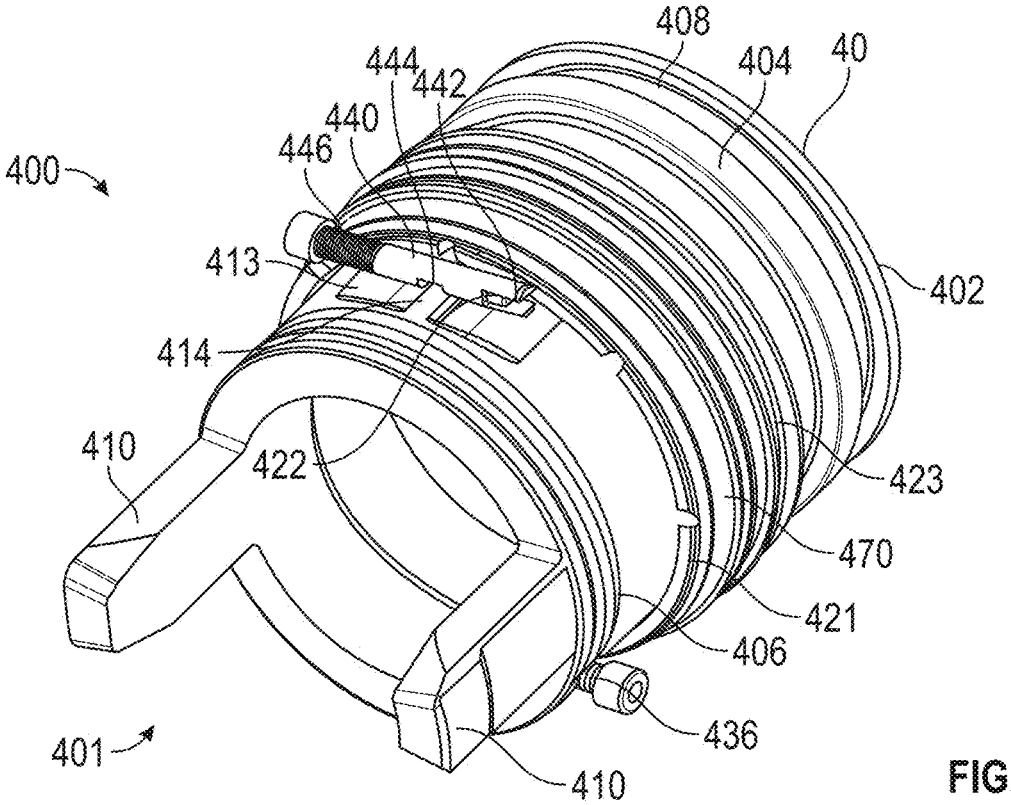
Figure 14:
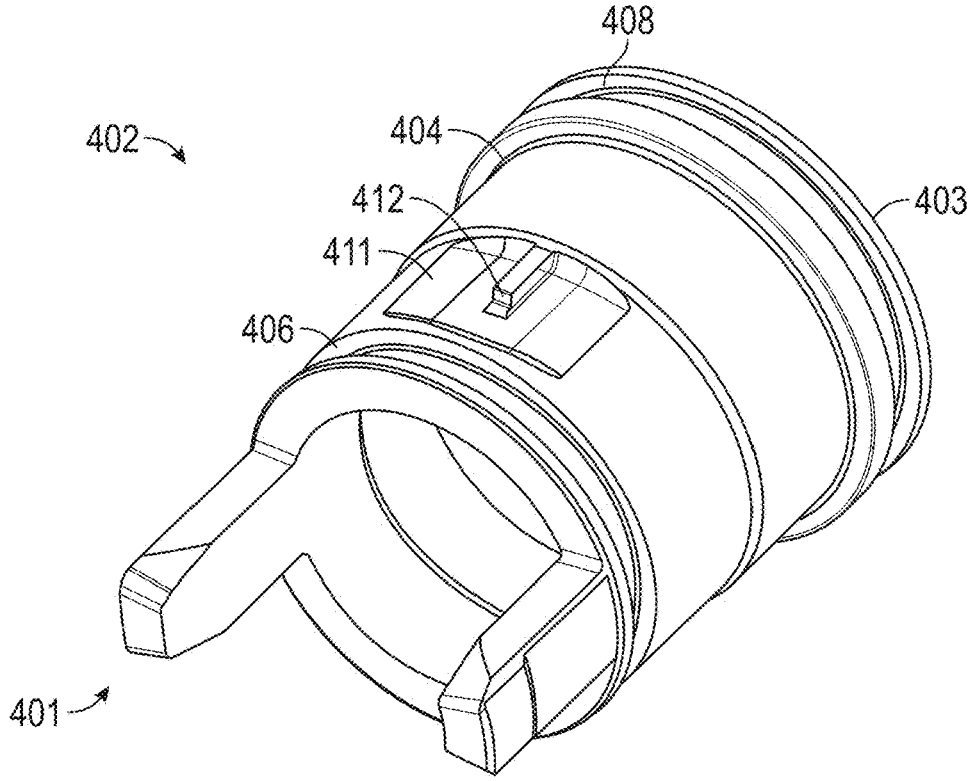
FIGS. 14, 15 are perspective views of an embodiment of a locking piston of the locking assembly of FIGS. 12, 13.
Figure 15:
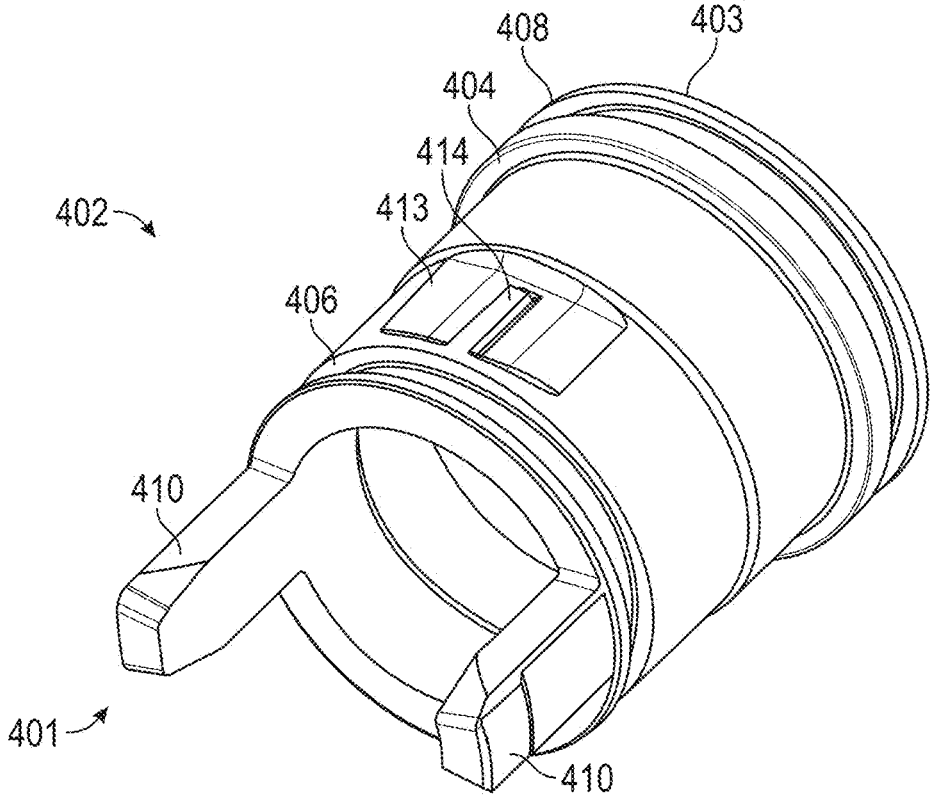
Figure 16:
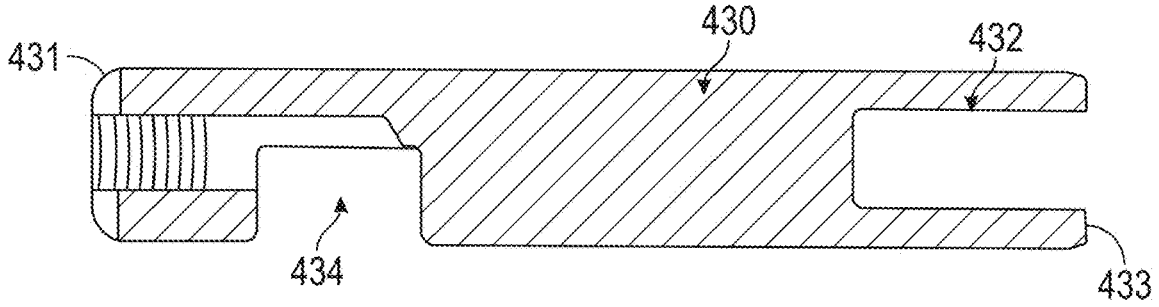
FIG. 16 is a cross-sectional side view of an embodiment of a locking pin of the locking assembly of FIGS. 12, 13.
Figure 17:
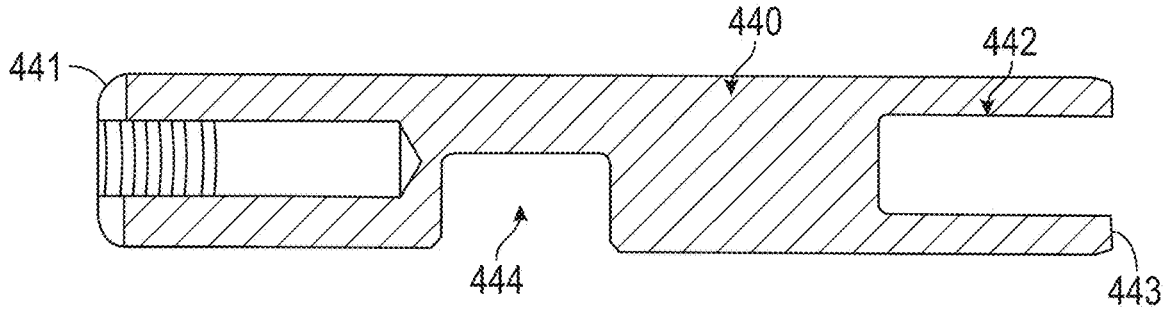
FIG. 17 is a cross-sectional side view of an embodiment of another locking pin of the locking assembly of FIGS. 12, 13.
Figure 18:
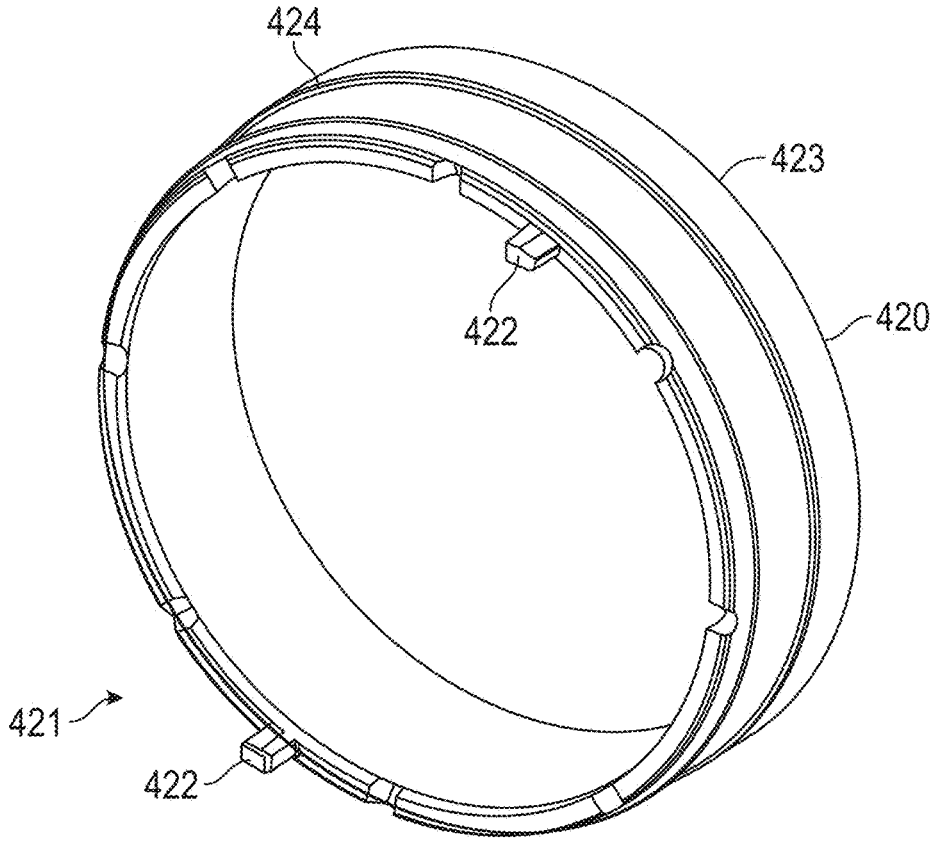
FIG. 18 is a perspective view of an embodiment of a locking sleeve of the locking assembly of FIGS. 12, 13.
Figure 19:
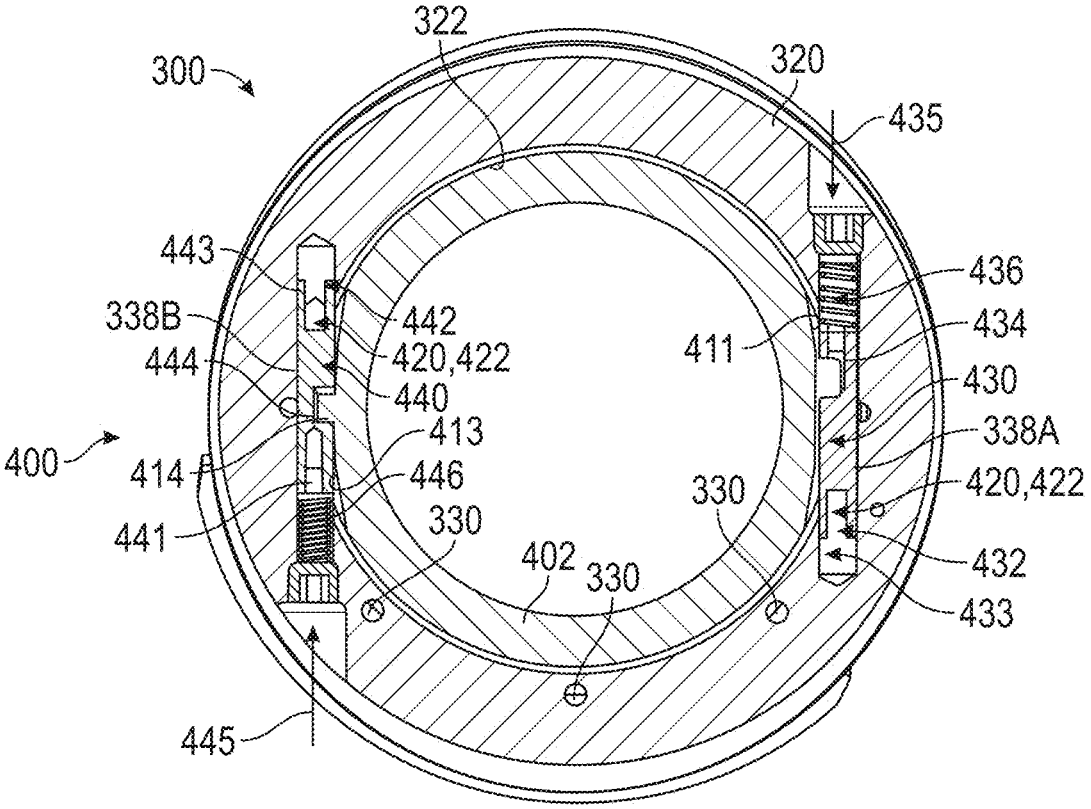
FIGS. 19, 20 are cross-sectional end views of the bend adjustment assembly of FIG. 5.

Referring now to FIG. 11, another embodiment of a lower adjustment mandrel 390 is shown. It may be understood that in some embodiments lower adjustment mandrel 390 may be used in the bend adjustment assembly 300 (and other bend adjustment assemblies which vary in configuration from bend adjustment assembly 300) in lieu of the lower adjustment mandrel 370 shown in FIG. 10.

In this exemplary embodiment, lower adjustment mandrel 390 has a first or upper end 391, a second or lower end 393, and a central bore or passage extending therebetween that is defined by a generally cylindrical inner surface. Additionally, in this exemplary embodiment, lower adjustment mandrel 390 includes a generally cylindrical outer surface comprising an offset engagement surface 392 which has a central or longitudinal axis that is offset or disposed at an angle relative to a central or longitudinal axis of the upper end 361 of upper adjustment mandrel 360 and the lower end 321 of lower housing 320.

In this exemplary embodiment, an annular seal 394 is disposed in the outer surface of lower adjustment mandrel 390 to sealingly engage the inner surface of lower housing 320. Additionally, a recess 399 is formed on the outer surface of lower adjustment mandrel 390 which extends arcuately between a pair of circumferentially spaced shoulders 395. A plurality of circumferentially spaced teeth or castellations 396 are formed in the arcuate recess 399 between shoulders 395. Lower adjustment mandrel 390 further includes a pair of circumferentially spaced first or short slots 397 and a pair of circumferentially spaced second or long slots 398. Both the short slots 397 and long slots 398 of lower adjustment mandrel 390 extend axially into lower adjustment mandrel 390 from the lower end 393 thereof. In this exemplary embodiment, each short slot 397 is circumferentially spaced approximately 180° apart. Similarly, each long slot 398 is circumferentially spaced approximately 180° apart.

Referring now to FIGS. 5, 6, and 12-19, as will be described further herein, locking assembly 400 prevents bend adjustment assembly from shifting from the first configuration 303 to the second configuration 305 until mud motor 35 has reached a predefined depth within wellbore 16. In other words, prior to reaching the predefined depth, mud motor 35 may be operated in any manner desired by an operator of well system 10 without inadvertently triggering the actuation of bend adjustment assembly 300 from the first configuration 303 to the second configuration 305. For example, the pumping of drilling fluid through drillstring 21 may be ceased without inadvertently unlocking bend adjustment assembly 300 from the first configuration 303 until the predefined depth has been achieved. Similarly, drilling fluid may be pumped through drillstring 21 at a maximum drilling pressure without inadvertently unlocking bend adjustment assembly 300 from the first configuration 303 until the predefined depth has been achieved. The maximum drilling pressure may correspond to a maximum discharge pressure of mud pump 23 that may be safely and practically delivered by mud pump 23. To state in other words, locking assembly 400 allows mud motor 35 to be operated as if bend adjustment assembly 300 were not present therein until the predefined depth has been achieved.

In this exemplary embodiment, locking assembly 400 generally includes a locking piston 402, a locking sleeve 420, a rupture disk 426, a first locking pin 430, and a second locking pin 440 circumferentially spaced from the first locking pin 430. Locking piston 402 is generally tubular and has a first or upper end 401, a second or lower end 403, and a central bore or passage extending therebetween. Locking piston 402 includes a generally cylindrical outer surface comprising an annular shoulder 404 positioned axially between a pair of annular seals 406, 408 positioned on the outer surface of locking piston 402.

Locking piston 402 additionally includes a pair of circumferentially spaced keys 410 that extend axially from upper end 401, where each key 410 extends through one of the circumferentially spaced slots 331 of lower housing 320. In this arrangement, relative rotation between locking piston 402 and lower housing 320 is restricted while relative axial movement is permitted therebetween. As will be discussed further herein, each key 410 is receivable in either one of the short slots 377 or long slots 378 of lower adjustment mandrel 370 depending on the relative angular position between locking piston 402 and lower adjustment mandrel 370.

In this exemplary embodiment, the outer surface of locking piston 402 additionally includes a pair of circumferentially opposed recesses 411, 413 formed therein. First recess 411 is circumferentially aligned with the first locking pin 430 and a first ledge 412 of locking piston 402 formed on the first recess 411 engages the first locking pin 430 as will be described further herein. Similarly, second recess 413 is circumferentially aligned with the second locking pin 440 and a second ledge 414 of locking piston 402 formed on the second recess 413 engages the second locking pin 440 as will be described further herein.

The combination of sealing engagement between seals 406, 408 of locking piston 402 and the inner surface 322 of lower housing 320 defines a lower axial end of locking chamber 395. Locking chamber 395 extends longitudinally from the lower axial end thereof to an upper axial end defined by the combination of sealing engagement between the outer seal of compensating piston 356 and the inner seal of piston 356. Particularly, lower adjustment mandrel 370 and upper adjustment mandrel 360 each include axially extending ports similar in configuration to the ports 330 of lower housing 320 such that fluid communication is provided between the annular space directly adjacent shoulder 404 of locking piston 402 and the annular space directly adjacent a lower end of compensating piston 356. Locking chamber 395 is sealed from annulus 116 such that drilling fluid flowing into annulus 116 is not permitted to communicate with fluid disposed in locking chamber 395, where locking chamber 395 is filled with lubricant.

The locking sleeve 420 of locking assembly 400 is positioned about locking piston 402 radially between the outer surface of locking piston 402 and the inner surface 322 of lower housing 320. In this exemplary embodiment, locking sleeve 420 includes a first or upper end 421, a second or lower end 423 opposite upper end 421, and a pair of circumferentially opposed fingers 422 extending from the upper end 421. Fingers 422 are circumferentially aligned with the locking pins 430, 440 of locking assembly 400 as will be described further herein. Additionally, a generally cylindrical outer surface of locking sleeve 420 includes an annular shoulder 424 formed thereon.

In this exemplary embodiment, the rupture disk 426 of locking assembly 400 is positioned in an internal fluid passage 334 of lower housing 320 which extends from a first opening formed in the internal shoulder 327S to a second opening formed in the inner surface 322 of lower housing 320. Additionally, lower housing 320 includes a pair of annular seals 336 positioned on the inner surface 322 of lower housing 320 and flanking the second opening of fluid passage 334. Each of the seals 336 sealingly engages the outer surface of locking sleeve 420 such that while fluid communication between fluid passage 334 and the shoulder 424 of locking sleeve 420 is permitted, fluid communication between the ends 421, 423 of locking sleeve 420 is restricted.

Fluid passage 334 may initially comprise or form an ambient chamber filled with air at ambient pressure. Rupture disk 426 is configured to burst or rupture in response to the mud motor 35 reaching the predefined depth within wellbore 16, causing fluid pressure within fluid passage 334 to increase and equalize with the fluid pressure in the central passage of lower housing 320. The increase in pressure within fluid passage 334 is applied to the shoulder 424 of locking sleeve 420 as will be described further herein.

In some embodiments, the rupture disk 426 is configured to burst in response to fluid pressure within bend adjustment assembly 300 reaching a pressure corresponding to the predefined depth. A static or head pressure of the drilling fluid flowing through bend adjustment assembly 300 increases as the depth of mud motor 35 within wellbore 16 increases. In addition to the head pressure dependent on the depth of mud motor 35 within wellbore 16, a dynamic pressure is added to the drilling fluid by mud pump 23, where the pressure of the drilling fluid flowing through bend adjustment assembly 300 at a given time is equal to the combined head pressure (dependent on the depth of the mud motor 35) and dynamic pressure (dependent on the operation of mud pump 23) of the drilling fluid. In some embodiments, the rupture disk 426 is configured to burst when the head pressure of the drilling fluid within bend adjustment assembly 300 corresponds to the predefined depth and the dynamic pressure of the drilling fluid is equal to the maximum drilling pressure delivered by mud pump 23.

First locking pin 430 initially holds or restrains locking piston 402 in a first or initial axial position before mud motor 35 achieves the predefined depth within wellbore 16. First locking pin 430 has a longitudinal first end 431, a longitudinal second end 433 opposite first end 431, an outer receptacle 432 extending longitudinally into second end 433, and a slotted opening 434 located between ends 431, 433. A first biasing member 436 of locking assembly 400 biases first locking pin 430 in a first lateral direction 435 (shown in FIG. 19) that extends orthogonal the central axis of lower housing 320. The first locking pin 430 and first biasing member 436 are each positioned in a first lateral slot 338A formed in the lower housing 320 of bend adjustment assembly 300 where both the outer receptacle 432 and slotted opening 434 of first locking pin 430 are positioned within the central passage of lower housing 320.

Second locking pin 440 locks the locking piston 402 in a second or set axial position that is spaced from the initial axial position of locking piston 402. As will be described further herein, locking piston 402 travels from the initial axial position to the set axial position during the actuation of bend adjustment assembly 300 from the first configuration 303 to the second configuration 305 once mud motor 35 achieves the predefined depth within wellbore 16.

Similar to first locking pin 430 described above, second locking pin 440 has a longitudinal first end 441, a longitudinal second end 443 opposite first end 441, an outer receptacle 442 extending longitudinally into second end 443, and a slotted opening 444 located between ends 441, 443. A second biasing member 446 of locking assembly 400 biases second locking pin 440 in a second lateral direction 445 (shown in FIG. 19) that extends orthogonal the central axis of lower housing 320 and is opposite the first lateral direction 435. Additionally, the second locking pin 440 and second biasing member 446 are each positioned in a second lateral slot 338B formed in lower housing 320 where both the outer receptacle 442 and slotted opening 444 of second locking pin 440 are positioned within the central passage of lower housing 320. In this exemplary embodiment, the location of slotted opening 444 is shifted closer to the second end 443 of second locking pin 440 compared to the location of slotted opening 434 of first locking pin 430. However, in other embodiments, the configuration of locking pins 430, 440 may vary.

In this exemplary embodiment, the first locking pin 430 is received in the first recess 411 of locking piston 402 while the second locking pin 440 is received in the second recess 413 of locking piston 402. Particularly, when bend adjustment assembly 300 is in the first configuration 303, the first ledge 412 of locking piston 402 is laterally offset from the slotted opening 434 of first locking pin 430 and contacts a side of the first locking pin 430. Contact between the first ledge 412 and first locking pin 402 prevents locking piston 402 from travelling upwards from the initial axial position to the set axial position. Additionally, when bend adjustment assembly 300 is in the first configuration 303, one of the fingers 422 of locking sleeve 420 is received in the outer receptacle 432 of first locking pin 430, preventing first locking pin 430 from travelling in the first lateral direction 435 from a first or initial lateral position (corresponding to the first configuration 303 of bend adjustment assembly 300) to a second or set lateral position that is spaced in the first lateral direction 435 from the initial lateral position.

Further, when bend adjustment assembly 300 is in the first configuration 303, the second ledge 414 of locking piston 402 is laterally aligned with and received in the slotted opening 444 of second locking pin 440. Additionally, when bend adjustment assembly 300 is in the first configuration 303, the other of the fingers 422 of locking sleeve 420 is received in the outer receptacle 442 of second locking pin 440, preventing second locking pin 440 from travelling in the second lateral direction 445 from a first or initial lateral position (corresponding to the first configuration 303 of bend adjustment assembly 300) to a second or set lateral position that is spaced in the second lateral direction 445 from the initial lateral position.

Figure 7:
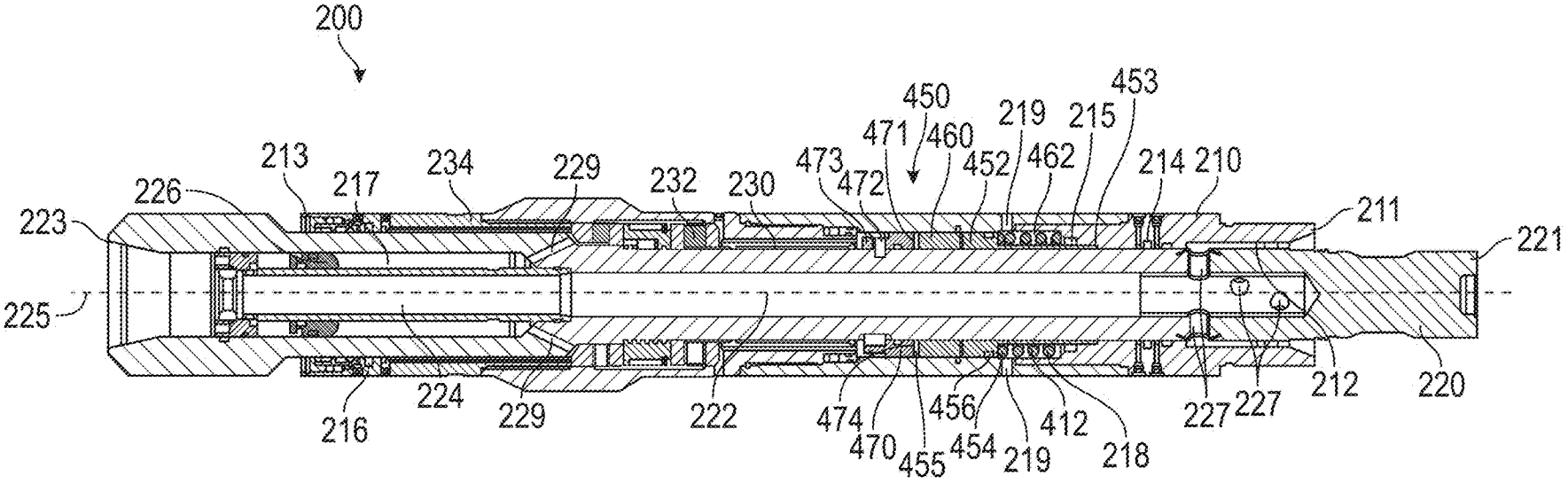
FIG. 7 is a cross-sectional side view of an embodiment of a bearing assembly of the downhole mud motor of FIG. 4.
Figure 8:
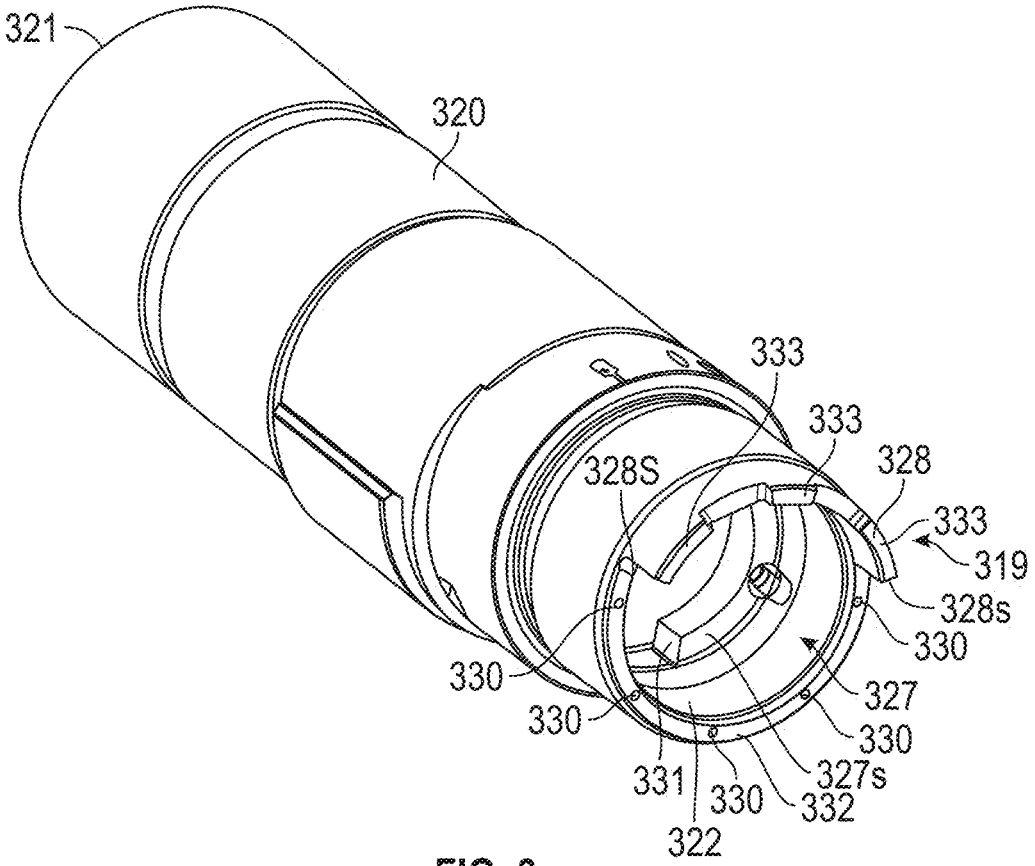
FIG. 8 is a perspective view of an embodiment of an offset housing of the bend adjustment assembly of FIG. 5.
Figure 9:
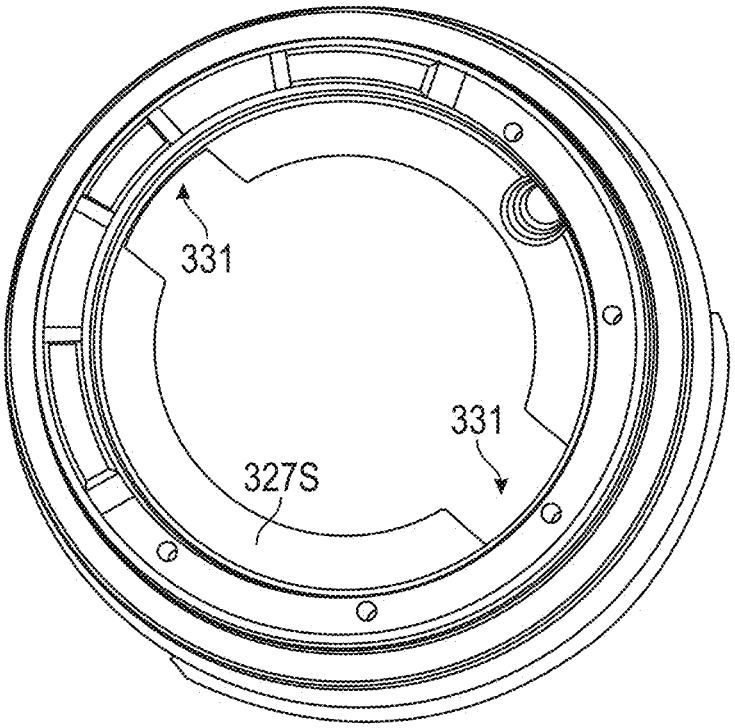
FIG. 9 is a front view of the offset housing of FIG. 8.

Referring now to FIG. 7, actuator assembly 450 of bend adjustment assembly 300 forces or causes bend adjustment assembly 300 to actuate from the first configuration 303 to the second configuration 305 after mud motor 35 has achieved the predefined depth within wellbore 16. In this exemplary embodiment, actuator assembly 450 generally includes an actuator piston 452 and a torque transmitter or teeth ring 470. Actuator piston 452 of actuator assembly 450 is slidably disposed about bearing mandrel 220 and has a first or upper end 453, a second or lower end 455, and a central bore or passage extending therebetween. In this exemplary embodiment, actuator piston 452 has a generally cylindrical outer surface including an annular shoulder 454 and an annular seal 456 located axially between shoulder 454 and lower end 455. The outer surface of actuator piston 452 includes a plurality of radially outwards extending and circumferentially spaced keys received in slots of the bearing housing 210 to restrict relative rotation between actuator piston 452 and bearing housing 210 while permitting actuator piston 452 to slide axially relative bearing housing 210. Additionally, in this exemplary embodiment, actuator piston 452 includes a plurality of circumferentially spaced locking teeth 460 extending axially from lower end 455.

In this exemplary embodiment, seal 456 of actuator piston 452 sealingly engages the inner surface 212 of bearing housing 210 and the seal 215 of bearing housing 210 sealingly engages the outer surface of actuator piston 452 to form an annular, sealed compensating chamber 412 extending therebetween. Fluid pressure within compensating chamber 412 is compensated or equalized with the surrounding environment (e.g., wellbore 16) via ports 219 of bearing housing 210. Additionally, an annular biasing member 462 is disposed within compensating chamber 412 and applies a biasing force against shoulder 454 of actuator piston 452 in the axial direction of teeth ring 470.

Teeth ring 470 of actuator assembly 450 is generally tubular and comprises a first or upper end 471, a second or lower end 473, and a central bore or passage extending between ends 471 and 473. Teeth ring 470 is coupled to bearing mandrel 220 via a plurality of circumferentially spaced splines or pins 472 disposed radially therebetween. In this arrangement, relative axial and rotational movement between bearing mandrel 220 and teeth ring 470 is restricted. In this exemplary embodiment, teeth ring 470 comprises a plurality of circumferentially spaced teeth 474 extending from upper end 471. Teeth 474 of teeth ring 470 are configured to matingly engage or mesh with the teeth 460 of actuator piston 452 when biasing member 462 biases actuator piston 452 into contact with teeth ring 470, as will be discussed further herein.

In this exemplary embodiment, actuator assembly 450 is both mechanically and hydraulically biased during operation of mud motor 35. Additionally, the driveline of mud motor 35 is independent of the operation of actuator assembly 450 while drilling, thereby permitting 100% of the available torque provided by power section 40 to power drill bit 90 when actuator assembly 450 is disengaged. The disengagement of actuator assembly 450 may occur at high flowrates through mud motor 35, and thus, when higher hydraulic pressures are acting against actuator piston 452. Additionally, in some embodiments, actuator assembly 450 may be used to rotate something parallel to bearing mandrel 220 instead of being used like a clutch to interrupt the main torque carrying driveline of mud motor 35. In this configuration, actuator assembly 450 comprises a selective auxiliary drive that is simultaneously both mechanically and hydraulically biased. Further, this configuration of actuator assembly 450 allows for various levels of torque to be applied as the hydraulic effect can be used to effectively reduce the preload force of biasing member 462 acting on mating teeth ring 470. This type of angled tooth clutch may be governed by the angle of the teeth (e.g., teeth 474 of teeth ring 470), the axial force applied to keep the teeth in contact, the friction of the teeth ramps, and the torque engaging the teeth to determine the slip torque that is required to have the teeth slide up and turn relative to each other.

In some embodiments, actuator assembly 450 permits rotation in mud motor 35 to rotate rotor 50 and bearing mandrel 220 until bend adjustment assembly 300 has fully actuated from the first configuration 303 to the second configuration 305, and then, subsequently, ratchet or slip while transferring relatively large amounts of torque to bearing housing 210. This reaction torque may be adjusted by increasing the hydraulic force or hydraulic pressure acting on actuator piston 452, which may be accomplished by increasing flowrate through mud motor 35. When additional torque is needed a lower flowrate or fluid pressure can be applied to actuator assembly 450 to modulate the torque and thereby rotate bend adjustment assembly 300. The fluid pressure is transferred to actuator piston 452 by compensating piston 226. In some embodiments, the pressure drop across drill bit 90 may be used to increase the pressure acting on actuator piston 452 as flowrate through mud motor 35 is increased.

Referring now to FIGS. 4-7, 19-21, having described the structure of the embodiment of driveshaft assembly 100, bearing assembly 200, and bend adjustment assembly 300, an embodiment for operating assemblies 100, 200, and 300 will now be described. As described above, bend adjustment assembly 300 includes first configuration 303 shown in FIGS. 4, 5 and second configuration 305 shown in FIGS. 20, 21. In this exemplary embodiment, first configuration 303 of assembly 300 corresponds to a low bend setting providing a first non-zero deflection angle $\theta_1$ while second configuration 305 corresponds to a high bend setting providing a second deflection angle $\theta_2$ that is greater than the first non-zero deflection angle $\theta_1$. In other embodiments, the first configuration 303 or second configuration 305 may correspond to a straight setting providing a 0° deflection angle $\theta$.

In this exemplary embodiment, mud motor 35 may be operated to drill wellbore 16 with bend adjustment assembly 300 locked into the first configuration 303 until mud motor 35 reaches the predefined depth at which point locking assembly 400 is configured to automatically unlock bend adjustment assembly 300 such that bend adjustment assembly 300 may be actuated from the first configuration 303 to the second configuration 305. Locking assembly 400 includes a first or locked configuration which prevents actuator assembly 350 from shifting bend adjustment assembly 300 from the first configuration 303 to the second configuration 305 irrespective of the manner in which mud motor 35 is operated (e.g., irrespective of the flowrate of drilling fluid through mud motor 35 and/or the amount of rotational torque applied to mud motor 35 from the rotary system 24). Locking assembly 400 is configured to automatically actuate from the locked configuration to an unlocked configuration upon the mud motor 35 reaching the predefined depth in wellbore 16. In the unlocked configuration, locking assembly 400 permits actuator assembly 450 to actuate the bend adjustment assembly 300 from the first configuration 303 to the second configuration 305, as will be described further herein.

Particularly, in the locked configuration of locking assembly 400, first locking pin 430 restrains or locks locking piston 402 into the initial axial position within lower housing 320. Additionally, the fingers 422 of locking sleeve 420 are received in the outer receptacles 432, 442 of locking pins 430, 440, respectively, preventing locking pins 430, 440 from travelling from their respective first lateral positions to their respective second lateral positions. Additionally, with locking assembly 400 in the locked configuration, lower adjustment mandrel 370 is axially locked in a first or initial axial position relative to upper adjustment mandrel 360 by shear pin 380. In the initial axial position of lower adjustment mandrel 370, castellations 333 of lower housing 320 interlock with the castellations 376 of lower adjustment mandrel 370, preventing relative rotation between lower adjustment mandrel 370 and lower housing 320. The prevention of relative rotation between housing 320 and mandrel 370 in-turn prevents bend adjustment assembly 300 from shifting from first configuration 303 to second configuration 305.

Upon reaching the predefined depth in wellbore 16, pressure within the central passage of lower housing 320 reaches a predefined burst pressure causing the rupture disk 426 to burst, exposing fluid passage 334 of lower housing 320 to the pressure of the drilling fluid flowing through bend adjustment assembly 300. This increase in fluid pressure is applied to the shoulder 424 of locking sleeve 420, forcing the locking sleeve 420 to travel axially through lower housing 320 until the lower end 423 of locking sleeve 420 contacts an annular ring or stop 342 positioned in lower housing 320.

Figure 20:
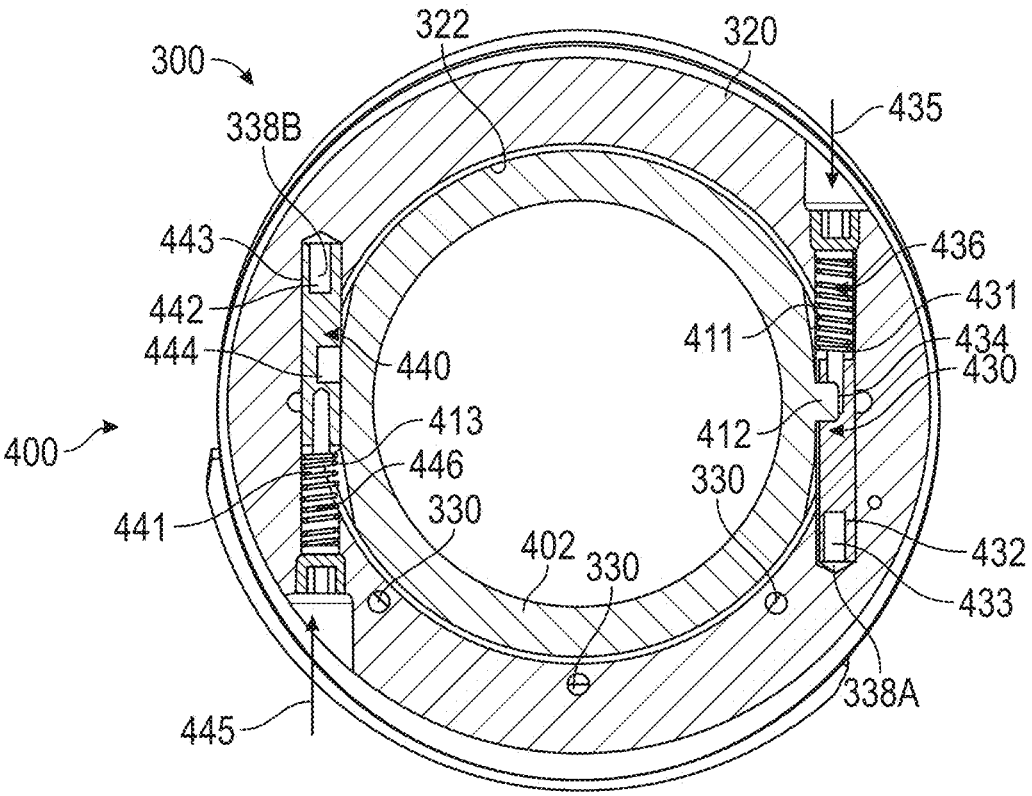

As locking sleeve 420 travels towards annular stop 342, the fingers 422 of locking sleeve 420 release from the outer receptacles 432, 442 of locking pins 430, 440, respectively, allowing biasing members 436, 446 to shift locking pins 430, 440, respectively, from their respective first lateral positions to their respective second lateral positions, as shown particularly in FIG. 20.

With first locking pin 430 in the second lateral position, the slotted opening 434 of first locking 430 aligns with the first ledge 412 of locking piston 402. In this arrangement, the net pressure force applied to locking piston 402 by the pressure of the drilling fluid flowing through bend adjustment assembly forces locking piston 402 from the initial axial position to the set axial position. Additionally, keys 410 of locking piston 402 press against the lower adjustment mandrel 370 as the locking piston 402 is shifted to the set axial position, thereby shearing the shear pin 380 connecting lower adjustment mandrel 370 with upper adjustment mandrel 360, and forcing lower adjustment mandrel 370 upwards from the initial axial position of mandrel 370 into a second or set axial position of lower adjustment mandrel 370. In the set axial position of lower adjustment mandrel 370, the castellations 333 of lower housing 320 are no longer interlocked with the castellations 376 of lower adjustment mandrel 370, thereby permitting relative rotation between lower housing 320 and lower adjustment mandrel 370.

With locking assembly 400 in the unlocked configuration and with lower adjustment mandrel 370 in the set axial position, bend adjustment assembly 300 may be actuated from the first configuration 303 to the second configuration 305 by rotating offset housings 310 and 320 relative adjustment mandrels 360 and 370 in response to varying a flowrate of drilling fluid through annulus 116 and/or varying the degree of rotation of drillstring 21 at the surface. As described above, offset bore 327 and offset engagement surface 323 of lower housing 320 are offset from central bore 329 and the central axis of housing 320 to form a lower offset angle, and offset engagement surface 365 of upper adjustment mandrel 360 is offset from the central axis of mandrel 360 to form an upper offset angle. Additionally, offset engagement surface 323 of lower housing 320 matingly engages the engagement surface 372 of lower adjustment mandrel 370 while the engagement surface 314 of upper housing 310 matingly engages the offset engagement surface 365 of upper adjustment mandrel 360.

In this configuration, the relative angular position between lower housing 320 and lower adjustment mandrel 370 determines the total offset angle (ranging from 0° to a maximum angle greater than) 0° between the central axes of lower housing 320 and driveshaft housing 110. The minimum angle occurs when the upper and lower offsets are in-plane and cancel out, while the maximum angle occurs when the upper and lower offsets are in-plane and additive. Therefore, by adjusting the relative angular positions between offset housings 310, 320, and adjustment mandrels 360, 370, the deflection angle $\theta$ and bend 301 of bend adjustment assembly 300 may be adjusted or manipulated.

The magnitudes of bend 301 in configurations 303 and 305 (e.g., the magnitudes of deflection angles $\theta_1$ and $\theta_2$) are controlled by the relative positioning of shoulders 328S and shoulders 375, which establish the extents of angular rotation in each direction. In this exemplary embodiment, lower housing 320 is provided with a fixed amount of spacing between shoulders 328S, while adjustment mandrel 370 can be configured with an optional amount of spacing between shoulders 375, allowing the motor to be set up with the desired bend setting options ($\theta_1$ and $\theta_2$) as dictated by a particular application simply by providing the appropriate configuration of lower adjustment mandrel 370.

Actuator assembly 450 controls the actuation of bend adjustment assembly 300 between first configuration 303 and second configuration 305. In this exemplary embodiment, actuator assembly 450 selectively or controllably transfers torque from bearing mandrel 220 (supplied by rotor 50) to bearing housing 210 in response to changes in the flowrate of drilling fluid supplied to power section 40. In this exemplary embodiment, to actuate bend adjustment assembly 300 from the first configuration 303 to the second configuration 305, the pumping of drilling mud from surface pump 23 and the rotation of drillstring 21 by rotary system 24 is ceased and/or reduced by a predetermined percentage from the maximum drilling flowrate of well system 10, where the maximum drilling flowrate of well system 10 is dependent on the application, including the size of drillstring 21 and BHA 30.

For instance, the maximum drilling flowrate of well system 10 may comprise the maximum drilling flowrate that may be pumped through drillstring 21 and BHA 30 before components of drillstring 21 and/or BHA 30 are eroded or otherwise damaged by the mud flowing therethrough. In some embodiments, the reduced flowrate of drilling mud from surface pump 23 comprises approximately 1%-30% of the maximum drilling flowrate of well system 10; however, in other embodiments, the reduced flowrate may vary. For instance, in some embodiments, the reduced flowrate may comprise zero or substantially zero fluid flow.

In this exemplary embodiment, as drilling fluid flows through BHA 30 from drillstring 21 at the reduced flowrate, rotational torque is transmitted to bearing mandrel 220 via rotor 50 of power section 40 and driveshaft 120. Additionally, biasing member 462 applies a biasing force against shoulder 454 of actuator piston 452 to urge actuator piston 452 into contact with teeth ring 470, with teeth 460 of piston 452 in meshing engagement with the teeth 474 of teeth ring 470. In this arrangement, torque applied to bearing mandrel 220 is transmitted to bearing housing 210 via the meshing engagement between teeth 474 of teeth ring 470 (rotationally fixed to bearing mandrel 220) and teeth 460 of actuator piston 452 (rotationally fixed to bearing housing 210).

Rotational torque applied to bearing housing 210 via actuator assembly 450 is transmitted to offset housings 310, 320, which rotate (along with bearing housing 210) in a first rotational direction relative adjustment mandrels 360, 370. Particularly, extension 328 of lower housing 320 rotates through arcuate recess 379 of lower adjustment mandrel 370 until a shoulder 328S engages a corresponding shoulder 375 of recess 379, restricting further relative rotation between offset housings 310, 320, and adjustment mandrels 360, 370. Following the rotation of lower housing 320, bend adjustment assembly 300 forms second deflection angle $\theta_2$ with bend adjustment assembly 300 now in the second configuration 305.

With bend adjustment assembly 300 now in the second configuration 305, the flowrate of drilling mud from surface pump 23 is increased from the reduced flowrate to an increased flowrate. In some embodiments, the increased flowrate of drilling mud from surface pump 23 comprises approximately 50%-100% of the maximum drilling flowrate of well system 10; however, in other embodiments, the increased flowrate may vary. The increased flowrate applies a net pressure force sufficient to overcome the biasing force applied against the upper end 401 of locking piston 402 via biasing member 354 to force the locking piston upwards into a locked position whereby the keys 410 of locking piston 402 are received in long slots 378 as shown particularly in FIG. 21.

Additionally, with drilling mud flowing through BHA 30 from drillstring 21 at the increased flowrate, fluid pressure applied against the lower end 455 of actuator piston 452 from the lubricant in chamber 217 is increased (due to the increased pressure of the drilling fluid which is transferred through piston 226), overcoming the biasing force applied against shoulder 454 by biasing member 462 and thereby disengaging actuator piston 452 from teeth ring 470. With actuator piston 452 disengaged from teeth ring 470, torque is no longer transmitted from bearing mandrel 220 to bearing housing 210. Further, in this exemplary embodiment, a flow restriction is formed between the inner surface of locking piston 402 and shoulder 122 of driveshaft 120 when locking piston 402 is in the locked position with keys 410 received in short slots 377 of lower adjustment mandrel 370, corresponding to first bend configuration 303. The flow restriction is deactivated when locking piston 402 is in the locked position with keys 410 received in long slots 377 of lower adjustment mandrel 370, corresponding to second bend configuration 305. The flow restriction may be registered or indicated by a pressure increase in the drilling fluid pumped into drillstring 21 by surface pump 23, where the pressure increase results from the backpressure provided by the flow restriction. Thus, bend adjustment assembly 300 provides a surface indication of the assembly 300 shifting into the second configuration 305.

Further, the second locking pin 440 retains locking piston 402 in the locked position with keys 410 received in long slots 378 such that relative rotation between lower adjustment mandrel 370 and lower housing 320 is restricted (keeping in mind relative rotation between locking piston 402 and lower housing 320 is restricted) and bend adjustment assembly 300 remains locked in the second configuration 305. Particularly, with locking piston 402 in the locked position and second locking pin 440 in the second lateral position, the slotted opening 444 is laterally offset from the second ledge 414 of locking piston 402. Instead, the second ledge 414 contacts or abuts a side of the second locking pin 440, preventing locking piston 402 from travelling downwards through lower housing 320 away from the locked position. Thus, in this exemplary embodiment, second locking pin 440 automatically relocks the locking assembly 400 into the locked configuration following the actuation of bend adjustment assembly 300 into the second configuration 305 such that assembly 300 cannot depart the second configuration 305 irrespective of changes in drilling fluid flowrate and/or rotation of mud motor 35 by rotary system 24.

In an alternative embodiment, the procedures for shifting bend adjustment assembly 300 between the first configuration 303 and the second configuration 305 may be reversed by reconfiguring lower adjustment mandrel 370 of bend adjustment assembly 300. Particularly, in this alternative embodiment, the position of arcuate recess 379 is shifted 180° about the circumference of lower adjustment mandrel 370. By shifting the angular position of arcuate recess 379 180° about the circumference of lower adjustment mandrel 370, the alternative embodiment of bend adjustment assembly 300 may be shifted from the first configuration 303 to the second configuration 305 by applying WOB to the mud motor 35 and activating rotary system 24 to rotate drillstring 21 to apply reactive torque to bearing housing 210 and rotate lower housing 320 relative to adjustment mandrel 370 in the second rotational direction, thereby shifting the alternative embodiment of bend adjustment assembly 300 into the second configuration 305.

Figure 26:
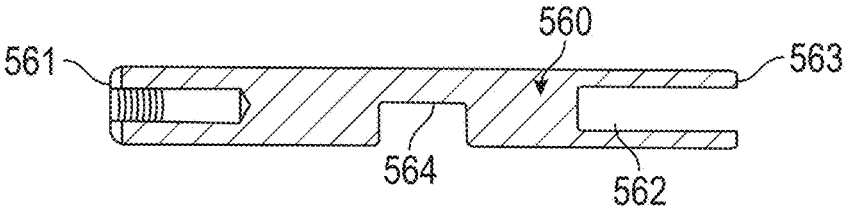
FIG. 26 is a side view of an embodiment of a locking pin of a locking assembly of the bend adjustment assembly of FIG. 22.
Figure 27:
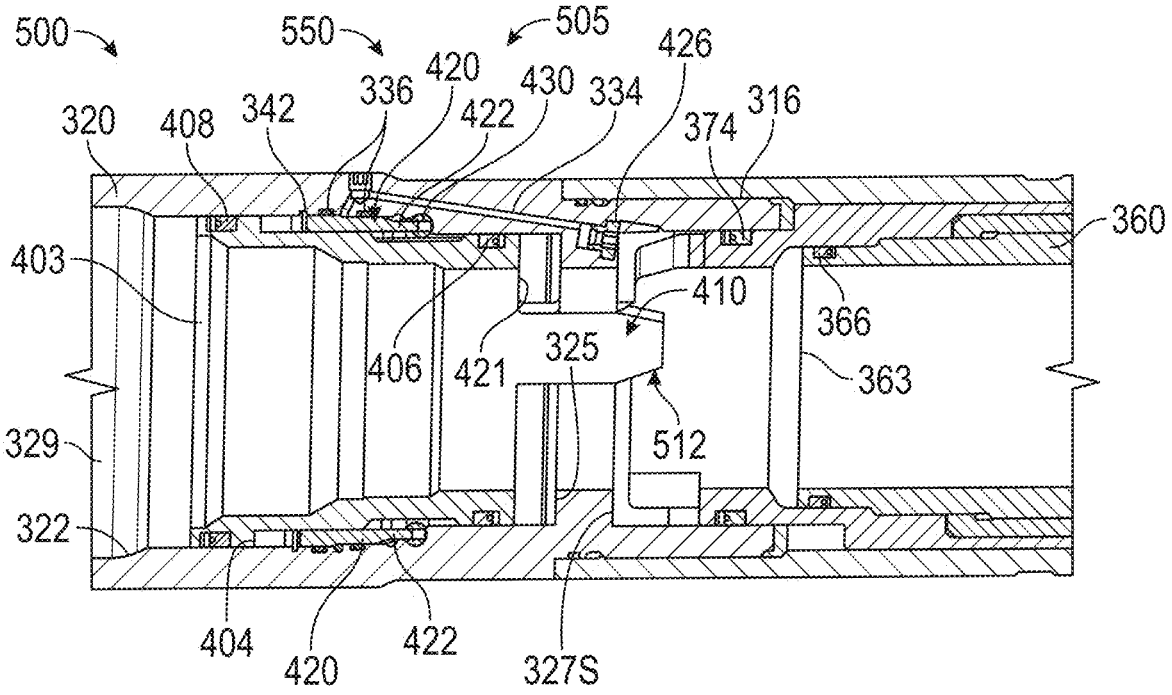
FIGS. 27, 28 are additional cross-sectional side views of the bend adjustment assembly of FIG. 22.
Figure 28:
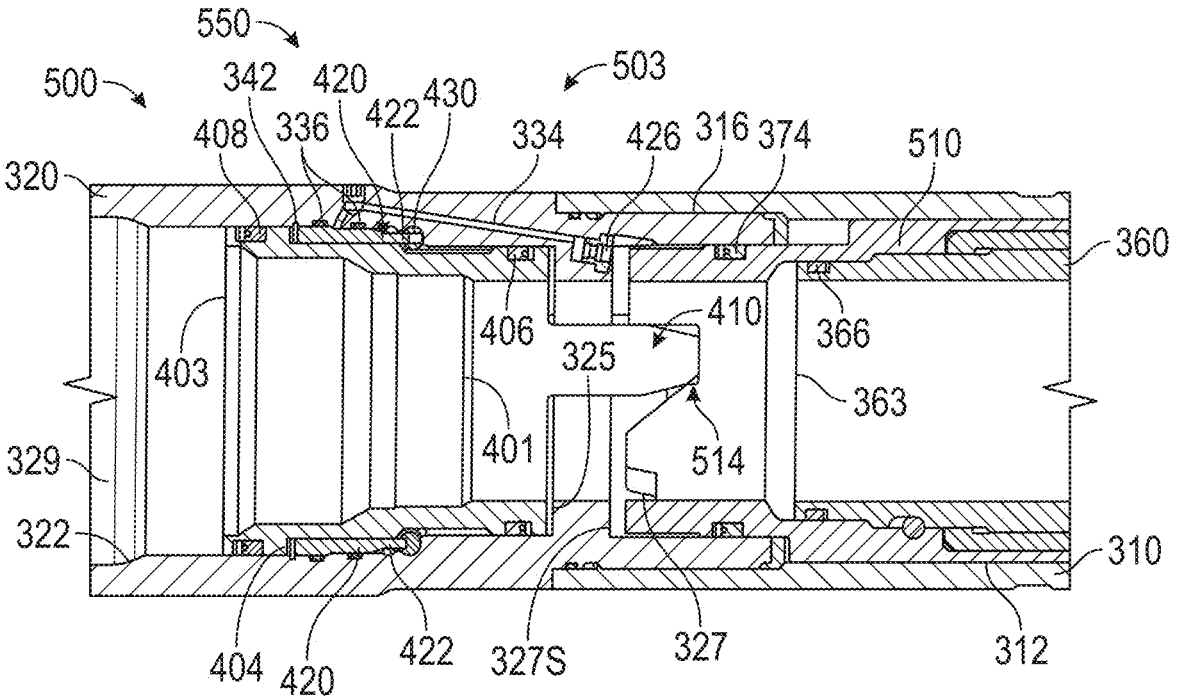
Figure 29:
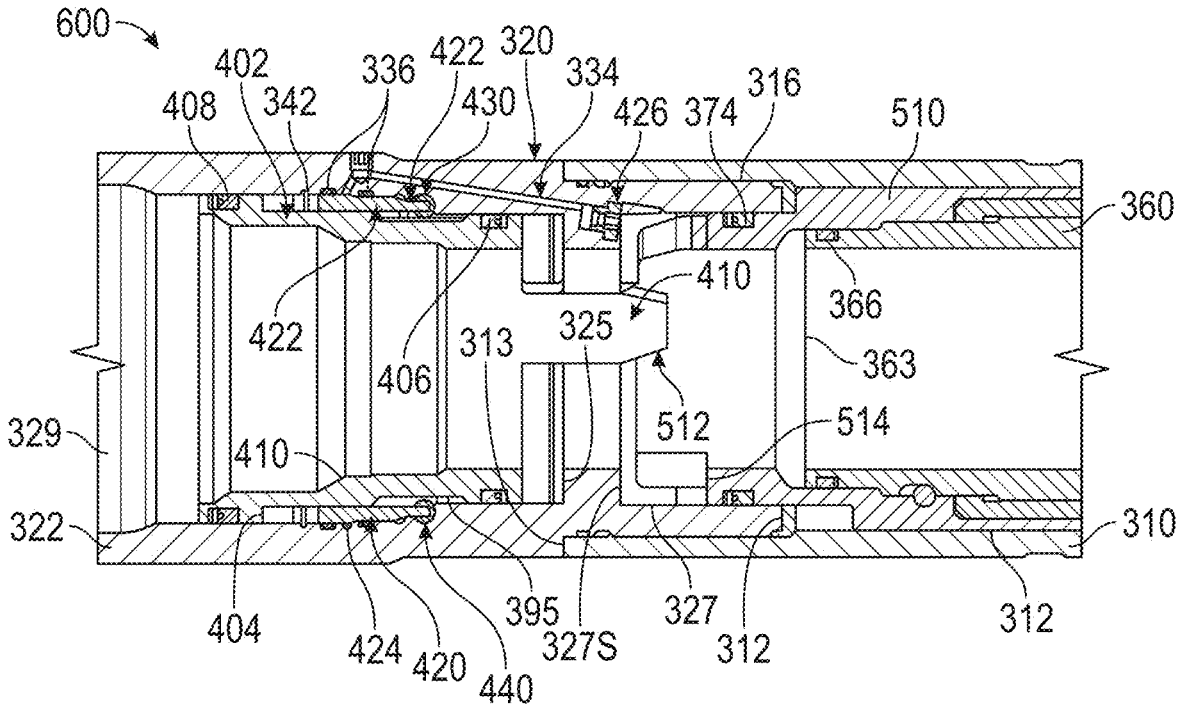
FIG. 29 is a cross-sectional side views of an embodiment of another bend adjustment assembly.
Figure 30:
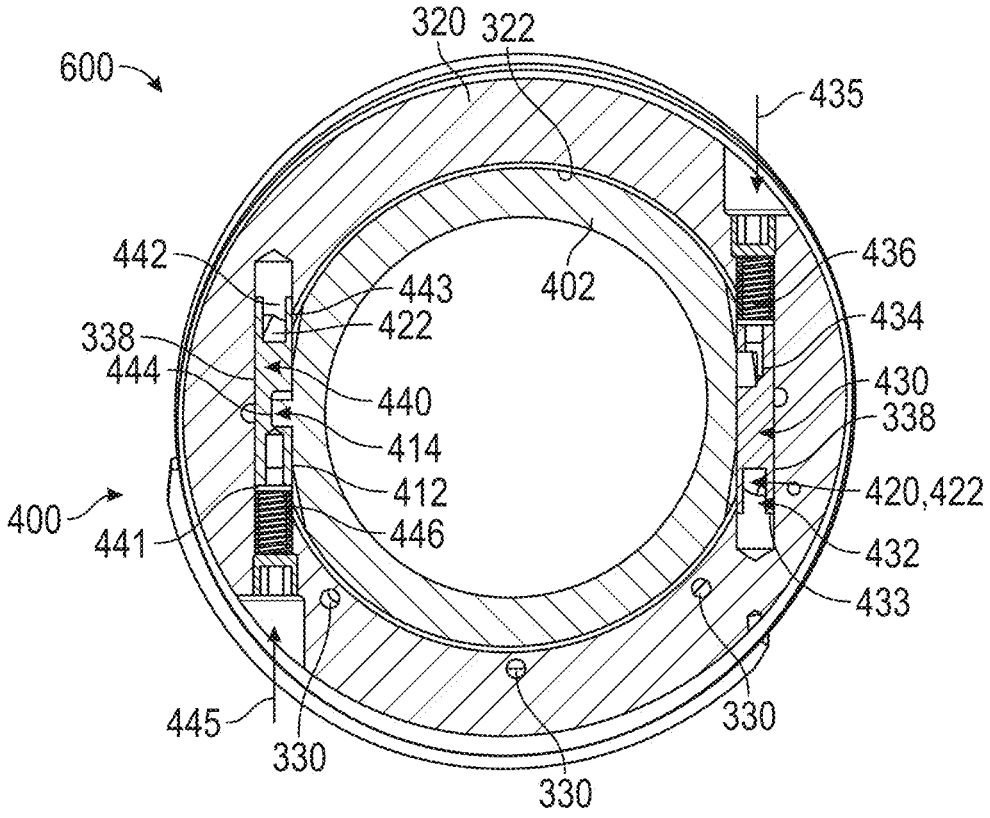
FIG. 30 is a cross-sectional end view of the bend adjustment assembly of FIG. 29.
Figure 31:
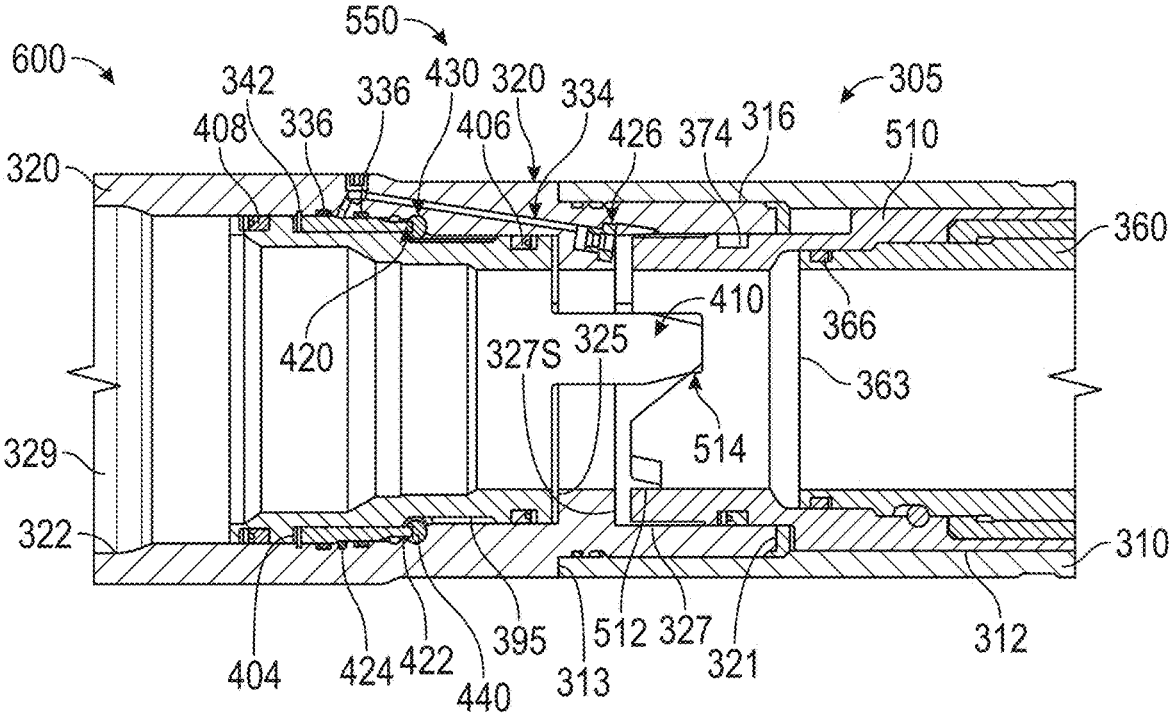
FIG. 31 is another cross-sectional side view of the bend adjustment assembly of FIG. 29.
Figure 32:
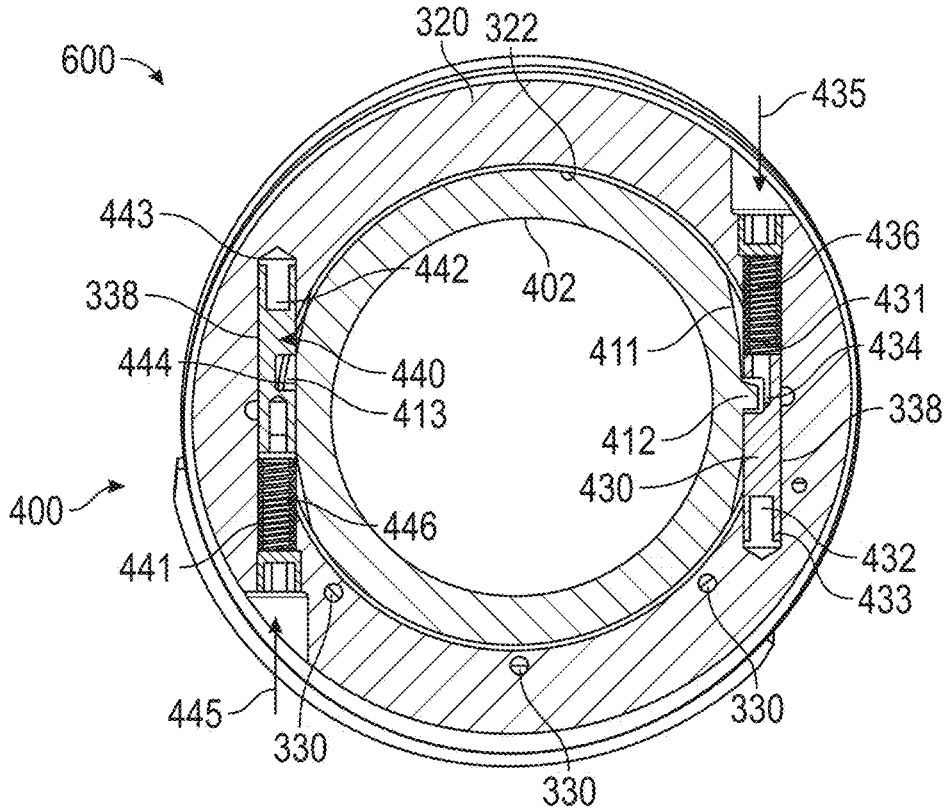
FIG. 32 is another cross-sectional end view of the bend adjustment assembly of FIG. 29.

In an alternative embodiment, rather than having second locking pin 440 automatically relock the locking assembly 400 into the locked configuration following the actuation of bend adjustment assembly 300 into the second configuration 305, a different configuration of locking pin may be used, as shown for example in FIG. 26, that is not acted on by a biasing member and does not engage second ledge 414 at any point during operation. This allows for unlimited shifting between first configuration 303 and second configuration 305 upon reaching the predefined depth in wellbore 16 and causing rupture disk 426 to burst.

The bend adjustment assembly 300 described above comprises a single-shift bend adjustment assembly 300 which shifts automatically upon reaching the predefined depth in wellbore 16 from the first configuration 303 to the second configuration 305. Prior to reaching the predefined depth the bend adjustment assembly 300 cannot be shifted from the first configuration 303 into a different configuration providing a different deflection angle θ by, for example, using a shear pin to hold the lower adjustment mandrel 370 in an axial position that keeps castellations 376 engaged with the castellations 333 of lower housing 320. Additionally, after shifting into the second configuration 305 once the predefined depth has been reached, the bend adjustment assembly 300 cannot be shifted from the second configuration 305 into another configuration providing a different deflection angle θ.

In some applications, it may be desirable to shift a downhole-adjustable bend assembly an indefinite number of times between separate configurations providing separate deflection angles without needing to retrieve the bend adjustment assembly from the wellbore. Referring now to FIGS. 22-28, another embodiment of a multi-shift bend adjustment assembly 500 is shown which may be locked in a first configuration 503 (shown in FIGS. 22-26) providing a first deflection angle θ, then activated at a predefined depth to unlock and allow shifting between a first configuration 503 (shown in FIG. 28) and a second configuration 505 (shown in FIG. 27) an unlimited number of times without needing to retrieve the bend adjustment assembly 500 to the surface. In some embodiments, mud motor 35 may comprise bend adjustment assembly 500 in lieu of bend adjustment assembly 300; however, in other embodiments, bend adjustment assembly 500 may comprise a component of mud motors which vary in configuration from mud motor 35.

Bend adjustment assembly 500 includes features in common with mud motor 300, and shared features are labeled similarly. Particularly, bend adjustment assembly 500 is similar to assembly 300 except that assembly 500 includes a lower adjustment mandrel 510 instead of lower adjustment mandrel 370 and a locking assembly 550 which includes an alternative second locking pin 560 instead of the second locking pin 440 of the locking assembly 400 described above. Second locking pin 560 has a longitudinal first end 561, a longitudinal second end 563 opposite first end 561, an outer receptacle 562 extending longitudinally into second end 563, and a slotted opening 564 located between ends 561, 563.

Figure 24:
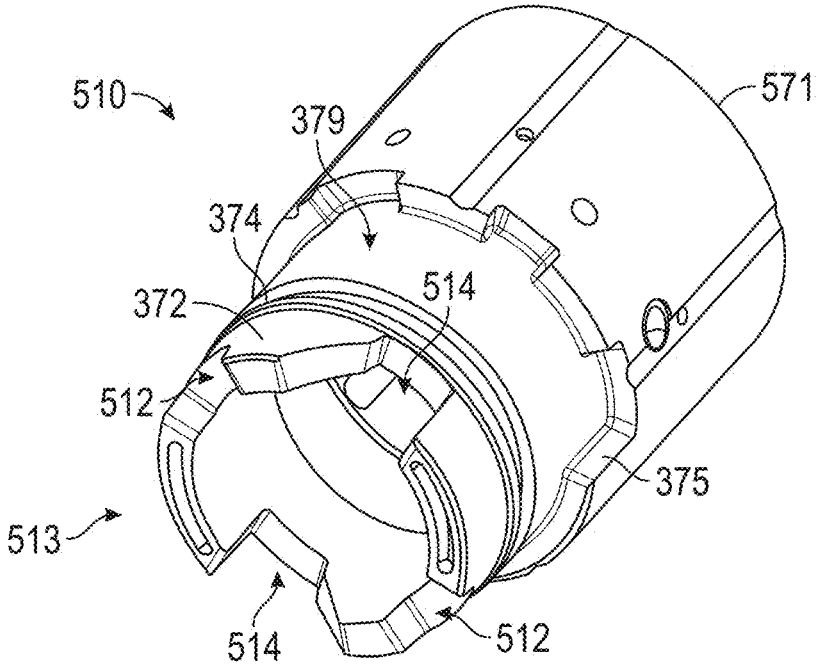
FIGS. 24, 25 are perspective views of an embodiment of an adjustment mandrel of the bend adjustment assembly of FIG. 22.
Figure 25:
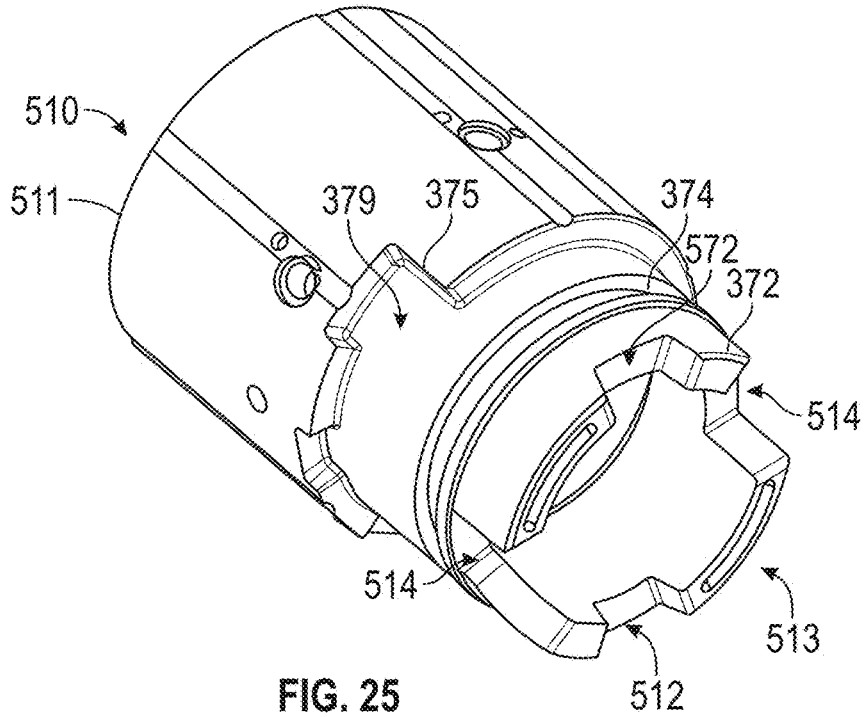

As shown particularly in FIGS. 24, 25, lower adjustment mandrel 510 of bend adjustment assembly 300 is generally tubular and has a first or upper end 511, a second or lower end 513, and a central bore or passage extending therebetween that is defined by a generally cylindrical inner surface. In this exemplary embodiment, lower adjustment mandrel 510 is splined to the upper adjustment mandrel 360 such that relative movement therebetween is restricted. Similar to the operation of lower adjustment mandrel 370 described above, when bend adjustment assembly 500 is disposed in the first configuration 503, a first deflection angle is provided between the central axis of lower housing 320 and the central axis of upper adjustment mandrel 360, and when bend adjustment assembly 500 is disposed in the second configuration 505, a second deflection angle is provided between the central axis of lower housing 320 and the central axis of upper adjustment mandrel 360 that is different from the first deflection angle.

In this exemplary embodiment, lower adjustment mandrel 510 additionally includes a pair of circumferentially spaced first or short slots 512 and a pair of circumferentially spaced second or long slots 514. Both the short slots 512 and long slots 514 of lower adjustment mandrel 510 extend axially into lower adjustment mandrel 370 from the lower end 513 thereof. In this exemplary embodiment, each short slot 512 is circumferentially spaced approximately 180° apart. Similarly, in this exemplary embodiment, each long slot 514 is circumferentially spaced approximately 180° apart. Additionally, each of the slots 512, 514 of lower adjustment mandrel 510 are configured to rotationally lock the lower housing 320 through the locking piston 402 to the lower adjustment mandrel 510 when the keys 410 of locking piston 402 are received in slots 512, 514. The locking between locking piston 402 and lower adjustment mandrel 510 via slots 512, 514 eliminates the need for castellations 376. Thus, although lower adjustment mandrel 510 is shown in FIGS. 24, 25 as including castellations, it may be understood that in this exemplary embodiment, neither lower housing 320 nor lower adjustment mandrel 510 need include castellations.

Additionally, unlike lower adjustment mandrel 370 described above, lower adjustment mandrel 510 of bend adjustment assembly 500 is axially locked to upper adjustment mandrel 360 such that axial movement is prevented therebetween at all times. In other words, mandrels 360, 510 are not connected by a shear pin in this embodiment intended to break during the operation of bend adjustment assembly 500. Instead, lower adjustment mandrel 510 remains in the same axial position relative upper adjustment mandrel 360 in both the first configuration 503 and second configuration 505 of bend adjustment assembly 500.

In the first configuration 503 of bend adjustment assembly 500, locking piston 402 is disposed in a locked position with keys 410 received in the long slots 514 of lower adjustment mandrel 510, preventing relative rotation between lower housing 320 and lower adjustment mandrel 370 (rotation being restricted between locking piston 402 and lower housing 320). Additionally, locking piston 402 is prevented by first locking pin 430 (due to engagement between pin 430 and second ledge 414) from shifting from the locked position to an unlocked position (axially spaced from the locked position) in which keys 410 are released from long slots 514. Thus, similar to bend adjustment assembly 300 described above, locking assembly 550 prevents bend adjustment assembly 500 from shifting from the first configuration 503 to the second configuration 505 until bend adjustment assembly 500 has reached the predefined depth at which rupture disk 426 is configured to burst.

Similar to the operation of locking assembly 400 described above, upon reaching the predefined depth and bursting rupture disk 426 (which can be accomplished automatically by reaching a given depth at a given mud weight or by increasing mud weight at the given depth such that the mud weight reaches a predefined mud weight threshold to thereby increase the hydrostatic pressure beyond the burst disk threshold), the locking sleeve 420 of locking assembly 550 shifts from the locked position to the unlocked position, releasing finger 422 of locking sleeve 420 from the outer receptacle 432 of first locking pin 430. First locking pin 430 is thus permitted to shift into the second lateral position via the biasing force applied by first biasing member 436, thereby aligning slotted opening 434 of first locking pin 430 with the second ledge 414 of locking piston 402.

In this configuration, the flowrate of drilling fluid through bend adjustment assembly 500 may be reduced and/or ceased to allow locking piston 402 to travel downwards into the unlocked position releasing keys 410 from long slots 514 of lower adjustment mandrel 510. With locking piston 402 in the unlocked position, drilling fluid may be flowed through the bend adjustment assembly 500 at the reduced flowrate to activate actuator assembly 450 and thereby rotate lower housing 320 in the first rotational direction relative to lower adjustment mandrel 510 until bend adjustment assembly 500 is shifted into the second configuration 505, as shown particularly in FIG. 24. Drilling fluid may then be flowed through bend adjustment assembly 500 at a rate above the reduced flowrate (e.g., at the maximum drilling flowrate) to shift locking piston 402 upwards into a locked position with keys 410 received in the short slots 512 of lower adjustment mandrel 510.

Unlike bend adjustment assembly 300 described above, second locking pin 560 does not lock bend adjustment assembly 500 into the second configuration 505. Instead, bend adjustment assembly 500 is permitted to actuate back-and-forth between the second configuration 505 and first configuration 503 by reducing and/or ceasing the flow of drilling fluid through bend adjustment assembly 500 to shift locking piston 402 into the unlocked position, and rotating lower housing 320 relative lower adjustment mandrel 510 via the actuator assembly 450. As an example, once in the second configuration 505, bend adjustment assembly 500 may be returned to the first configuration 503 with or without applying WOB to the mud motor 35 and activating rotary system 24 to rotate drillstring 21 to apply reactive torque to bearing housing 210 and rotate lower housing 320 relative to adjustment mandrel 510 in a second rotational direction, thereby shifting bend adjustment assembly 500 from the second configuration 505 to the first configuration 503.

Referring now to FIGS. 29-32, another embodiment of a bend adjustment assembly 600 is shown. Bend adjustment assembly 600 includes features in common with the bend adjustment assemblies 300, 500 described above, and shared features are labeled similarly. Particularly, bend adjustment assembly 600 comprises a single-shift bend adjustment assembly similar to bend adjustment assembly 300 except that, unlike bend adjustment assembly 300, bend adjustment assembly 600 comprises the lower adjustment mandrel 510 of bend adjustment assembly 500, which is axially locked to upper adjustment mandrel 360 such that axial movement is prevented therebetween at all times. As with bend adjustment assembly 500, the locking between locking piston 402 and lower adjustment mandrel 510 via slots 512, 514 eliminates the need for castellations 376.

In this exemplary embodiment, bend adjustment assembly 600 is in the second configuration 505 when locking assembly 500 is in the locked configuration and may only shift from the second configuration 505 to the first configuration once locking assembly 500 has automatically shifted into the unlocked configuration upon mud motor 35/bend adjustment assembly 600 reaching the predefined depth in the wellbore 16. Thus, while both bend adjustment assembly 300 and bend adjustment assembly 600 each comprise single-shift bend adjustment assemblies shiftable between configurations 303, 305, bend adjustment assembly 300 shifts from the first configuration 303 to the second configuration 305 after reaching the predefined depth in wellbore 16 while bend adjustment assembly 600 shifts from the second configuration 505 to the first configuration 503 after reaching the predefined depth. In this exemplary embodiment, bend adjustment assembly 600 may shift from a high bend setting to a low bend setting after reaching the predefined depth.

Figure 33:
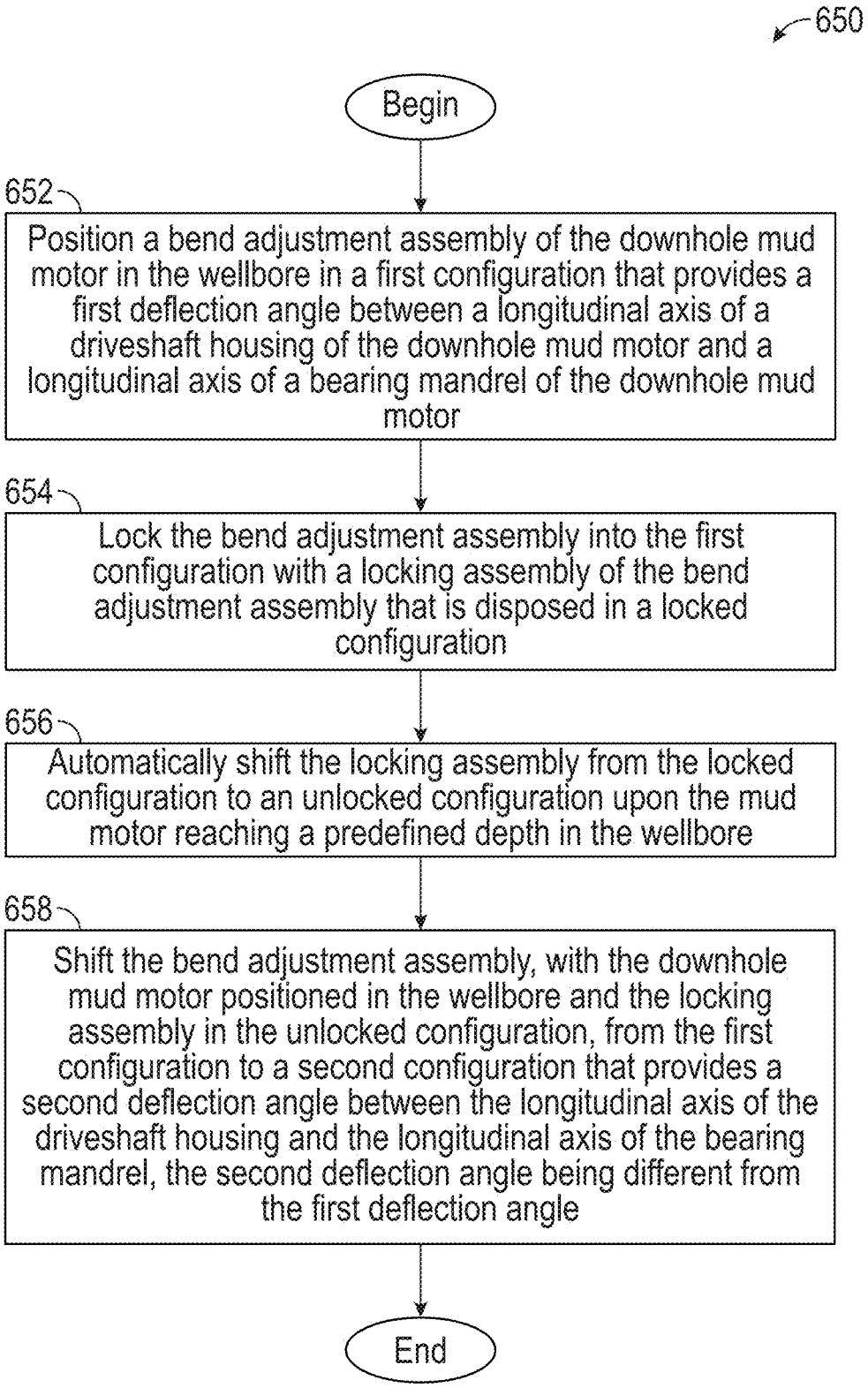
FIG. 33 is a flowchart of an embodiment of a method for forming a deviated wellbore using a downhole mud motor.

Referring now to FIG. 33, an embodiment of a method 650 for forming a deviated wellbore using a downhole mud motor is shown. Initially, at block 652 method 650 includes positioning a bend adjustment assembly of the downhole mud motor in the wellbore in a first configuration that provides a first deflection angle between a longitudinal axis of a driveshaft housing of the downhole mud motor and a longitudinal axis of a bearing mandrel of the downhole mud motor. In some embodiments, block 652 comprises positioning one of the bend adjustment assemblies 300, 500, and 600 of a downhole mud motor (e.g., mud motor 35) in wellbore 16 in a first configuration (e.g., one of configurations 303, 503, and 505) that provides a first deflection angle between the longitudinal axis 115 of driveshaft housing 110 and longitudinal axis 225 of bearing mandrel 220.

At block 654, method 650 comprises locking the bend adjustment assembly into the first configuration with a locking assembly of the bend adjustment assembly that is disposed in a locked configuration. In some embodiments, block 654 comprises locking one of the bend adjustment assemblies 300, 500, and 600 into the first configuration with one of the locking assemblies 400, 550. At block 656, method 650 comprises automatically shifting the locking assembly from the locked configuration to an unlocked configuration upon the mud motor reaching a predefined depth (which can be accomplished automatically by reaching a given depth at a given mud weight or by increasing mud weight at the given depth such that the mud weight reaches a predefined mud weight threshold to thereby increase the hydrostatic pressure beyond the burst disk threshold), in the wellbore. In some embodiments, block 656 comprises automatically shifting the locking assembly 400, 550 from the locked configuration to an unlocked configuration upon reaching the predefined depth in the wellbore 16.

At block 658, method 650 comprises shifting the bend adjustment assembly, with the downhole mud motor positioned in the wellbore and the locking assembly in the unlocked configuration, from the first configuration to a second configuration that provides a second deflection angle between the longitudinal axis of the driveshaft housing and the longitudinal axis of the bearing mandrel, the second deflection angle being different from the first deflection angle. In some embodiments, block 658 comprises shifting the bend adjustment assembly 300, 500, 600, with the downhole mud motor positioned in the wellbore 16 and the locking assembly 400, 550 in the unlocked configuration, from the first configuration to the second configuration 305, 505, and 503, respectively.

Figure 34:
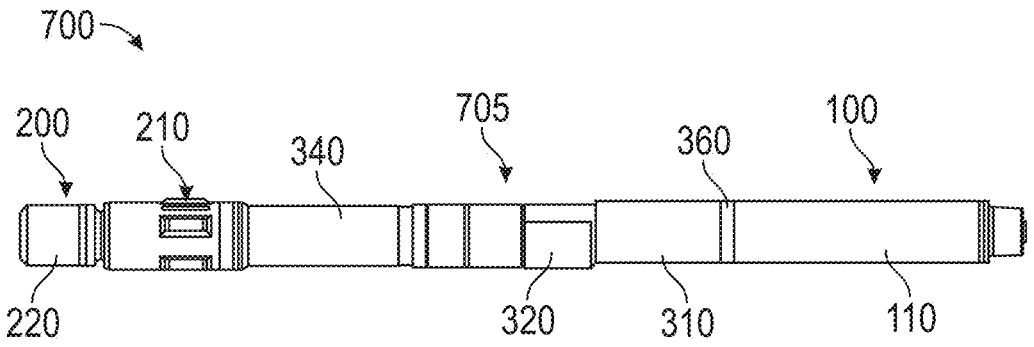
FIG. 34 is a side view of another embodiment of a downhole mud motor including a bend adjustment assembly in a first configuration in accordance with principles disclosed herein.
Figure 36:
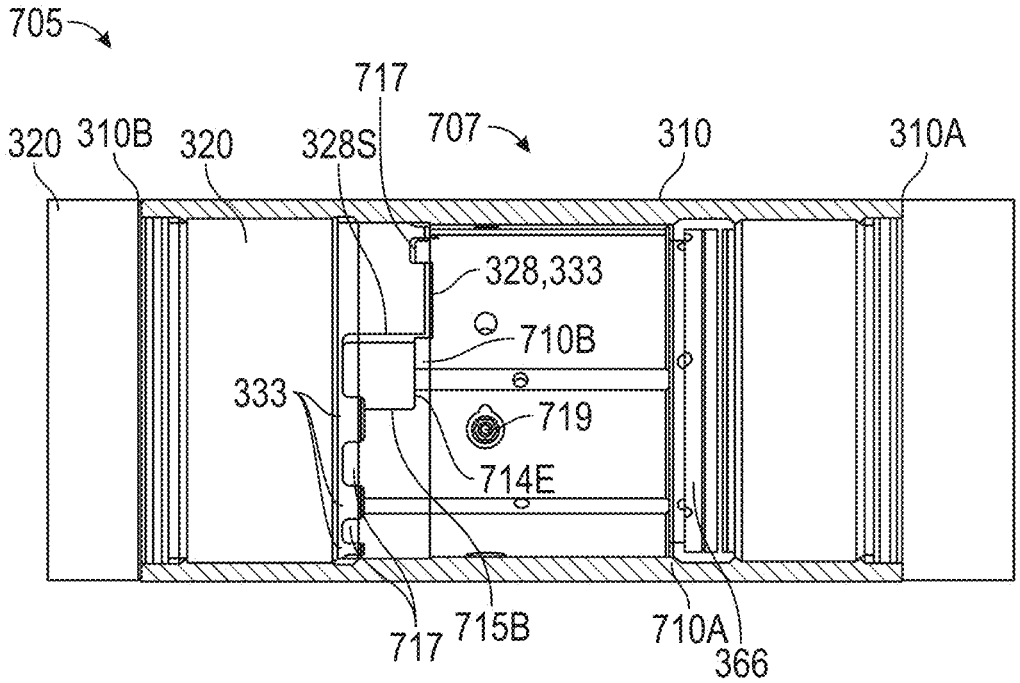
FIGS. 36 and 37 are opposing side views of the bend adjustment assembly of FIG. 34 in a first configuration.
Figure 37:
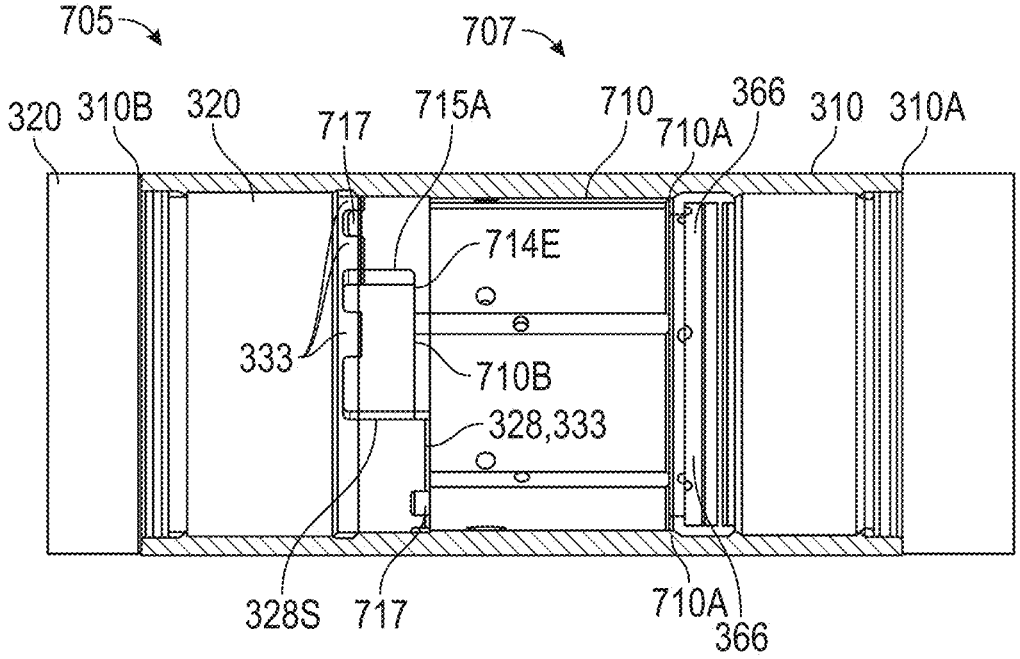
Figure 38:
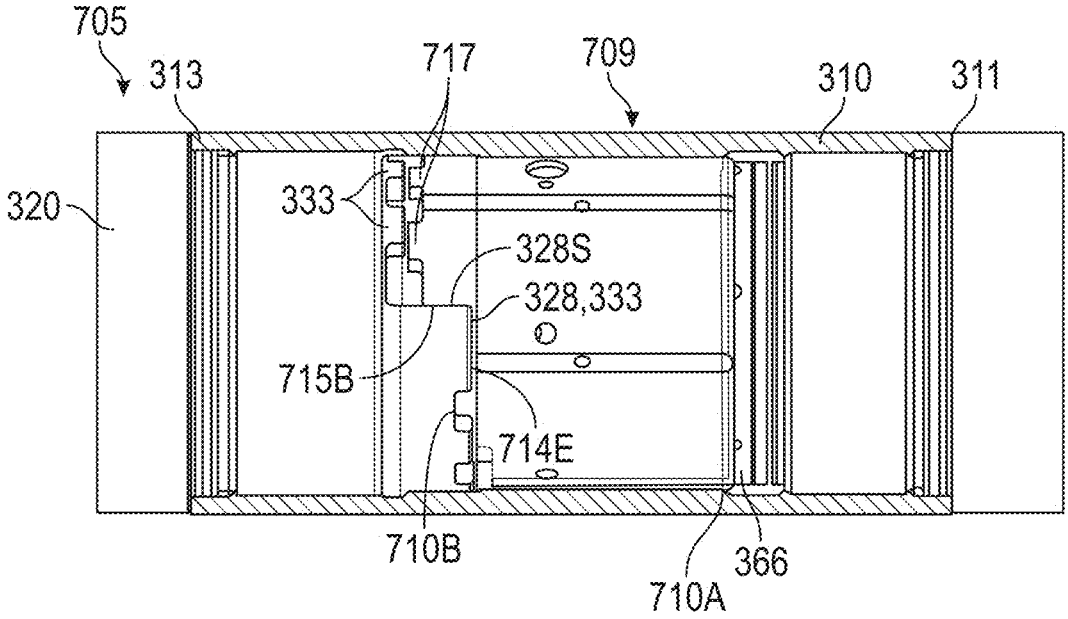
FIG. 38 is a side view of the bend adjustment assembly of FIG. 34 in a second configuration.
Figure 39:
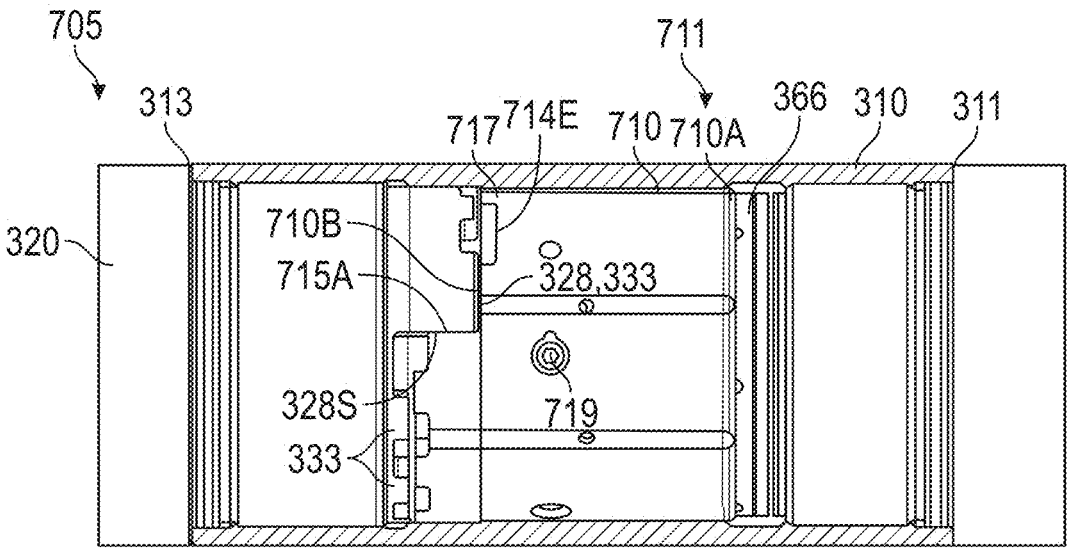
FIG. 39 is a side view of the bend adjustment assembly of FIG. 34 in a third configuration.

Referring now to FIG. 34, another embodiment of a downhole mud motor 700 is shown. Downhole mud motor 700 may replace the mud motor 40 described above in the BHA 30 shown in FIG. 1. Additionally, mud motor 700 includes features in common with mud motor 40, where shared features are labeled similarly. Mud motor 700 includes driveshaft assembly 100, bearing assembly 200, and a bend adjustment assembly 705. Similar to bend adjustment assembly 300 described above, bend adjustment assembly 705 is configured to shift from a first configuration 707 (shown in FIGS. 36 and 37 as further described below) providing a first deflection angle $\theta_1$ to a second configuration 709 (shown in FIG. 38 as further described below) providing a second deflection angle $\theta_2$ upon achieving a predefined depth in a wellbore (e.g. wellbore 16 shown in FIG. 1). In addition, after shifting from the first configuration 707 to the second configuration 709 upon achieving the predefined depth, bend adjustment assembly 705 is configured to shift from the second configuration 709 to a third configuration 711 (shown in FIG. 39 as further described below) providing a third deflection angle $\theta_1$ that is different from the first deflection angle $\theta_1$ and/or the second deflection angle $\theta_2$.

Figure 35:
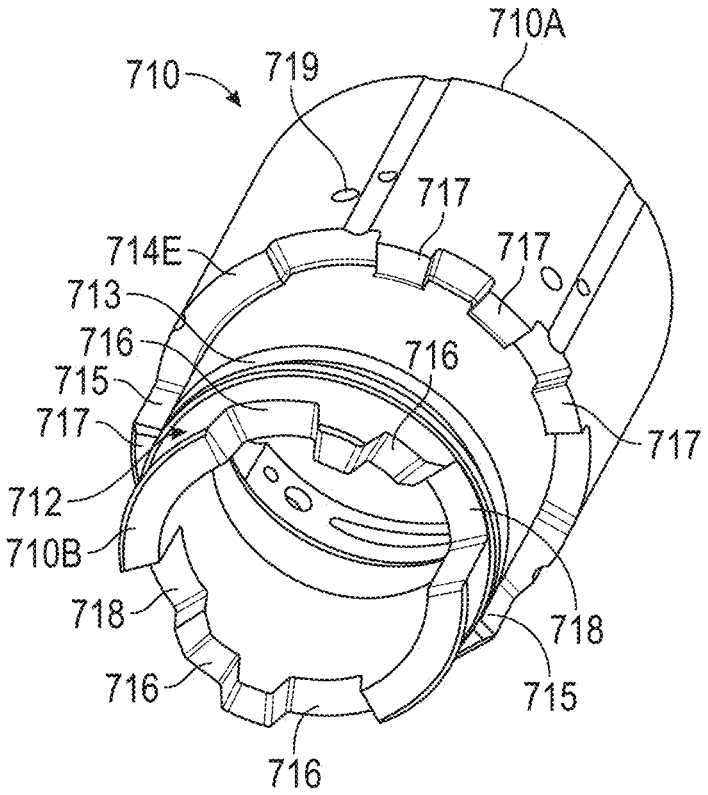
FIG. 35 is a perspective view of an embodiment of a lower adjustment mandrel of the bend adjustment assembly of FIG. 34 in accordance with principles disclosed herein.

Structurally, bend adjustment assembly 705 is similar in configuration to the bend adjustment assembly 300 described above except that bend adjustment assembly 705 includes a lower adjustment mandrel 710 in lieu of the lower adjustment mandrel 370 shown in FIG. 10. Referring to FIG. 35, lower adjustment mandrel 710 of bend adjustment assembly 705 is generally tubular and has a first or upper end 710A, a second or lower end 710B opposite upper end 710A, and a central bore or passage extending therebetween that is defined by a generally cylindrical inner surface. In this exemplary embodiment, lower adjustment mandrel 710 includes a generally cylindrical outer surface comprising an offset engagement surface 712, an annular seal 713, and an arcuately extending recess 714. Offset engagement surface 712 has a central or longitudinal axis that is offset or disposed at a non-zero angle relative to a central or longitudinal axis of the upper end 360A of upper adjustment mandrel 360 and the lower end 320B of lower housing 320, where offset engagement surface 712 is disposed directly adjacent or overlaps the offset engagement surface 323 of lower housing 320. Additionally, lower adjustment mandrel 710 includes a pair of circumferentially spaced stop shoulders 715A and 715B.

In this exemplary embodiment, when bend adjustment assembly 705 is disposed in the first configuration 707, a first deflection angle is provided between the central axis of lower housing 320 and the central axis of upper adjustment mandrel 360. When bend adjustment assembly 705 is in the first configuration 707 the bend adjustment assembly 705 cannot change its angular position and, unlike bend adjustment assembly 300 described above, all of the reactive torque loads (e.g., reactive torque applied to the drill bit 90 by the sidewall 19 of wellbore 16) are passed through castellations 717 and 333. Additionally, in this exemplary embodiment, the initial angular position of bend adjustment assembly 705 comprises a value in-between a maximum bend setting and a minimum bend setting of the bend adjustment assembly 705 without either of the large stop shoulders 715A and 715B being in contact with the 328S shoulders of lower housing 320.

When bend adjustment assembly 300 is disposed in the second configuration 709, a second deflection angle is provided between the central axis of lower housing 320 and the central axis of upper adjustment mandrel 360 that is different from the first deflection angle (shoulder 328S of lower housing 320 being in contact with shoulder 715A of lower adjustment mandrel 710 when in the second configuration 709), and when bend adjustment assembly 300 is disposed in the third configuration 711, a third deflection angle is provided between the central axis of lower housing 320 and the central axis of upper adjustment mandrel 360 that is different from both the first deflection angle and the second deflection angle (shoulder 328S of lower housing 320 being in contact with shoulder 715B of lower adjustment mandrel 710 when in the third configuration 709).

Annular seal 713 of lower adjustment mandrel 710 is disposed in the outer surface of lower adjustment mandrel 710 to sealingly engage the inner surface of lower housing 320. Arcuate recess 714 of lower adjustment mandrel 710 is defined by an inner terminal end or arcuate shoulder 714E and the pair of circumferentially spaced axially extending shoulders 715A and 715B. Lower adjustment mandrel 710 also includes a pair of circumferentially spaced first or short slots 716 and a pair of circumferentially spaced second or long slots 718, where both short slots 716 and long slots 718 extend axially into lower adjustment mandrel 710 from lower end 710B. In this embodiment, each short slot 716 is circumferentially spaced approximately 180° apart. Similarly, in this embodiment, each long slot 718 is circumferentially spaced approximately 180° apart; however, in other embodiments, the circumferential spacing of short slots 716 and long slots 718 may vary.

In this embodiment, the lower end 710B of lower adjustment mandrel 710 further includes a plurality of circumferentially spaced protrusions or castellations 717 configured to matingly or interlockingly engage the castellations 333 formed at the upper end 320A of lower housing 320. Castellations 717 are spaced substantially about the circumference of lower adjustment mandrel 710, and may be formed on the portion of the circumference of lower adjustment mandrel 710 comprising recess 714 as well as the portion of the circumference of lower adjustment mandrel 710 which is arcuately spaced from recess 714. Castellations 717 may be circumferentially spaced uniformly about a circumference of lower adjustment mandrel 710; alternatively, castellations 717 may only be positioned along a portion of the circumference of lower adjustment mandrel 710.

In some embodiments, lower adjustment mandrel 710 comprises a first or lower axial position (shown in FIGS. 36 and 37) relative lower housing 320 and upper adjustment mandrel 360, and a second or upper axial position relative lower housing 320 and upper adjustment mandrel 360 which is axially spaced from the lower axial position. When lower adjustment mandrel 710 is in the lower axial position, castellations 717 of lower adjustment mandrel 710 may interlock with castellations 333 of lower housing 320, restricting relative rotation therebetween. In this configuration, bend adjustment assembly 705 may be operated by an operator of well system 10 as a bend assembly that provides a fixed bend and thus may operate drillstring 21 and BHA 30 as desired without inadvertently actuating bend assembly 300 between configurations 705, 707, and 709. For example, with lower adjustment mandrel 710 disposed in the lower axial position, rotation of drillstring 21 and/or the flow of drilling fluid at a drilling flowrate through bend adjustment assembly 705 will not unlock or otherwise actuate bend adjustment assembly 705 from the first configuration 707 to either the second configuration 709 or third configuration 711 given the interlocking engagement between castellations 333 of lower housing 320 with castellations 717 of lower adjustment mandrel 710. However, when lower adjustment mandrel 710 is in the upper axial position (this movement of lower adjustment mandrel 710 occurs after achieving the predefined depth), castellations 717 of lower adjustment mandrel 710 are axially spaced and disengaged from castellations 333 of lower housing 320, permitting relative rotation therebetween. As will be described further herein, in some embodiments, lower adjustment mandrel 710 is initially retained in the lower axial position via a shear pin or member 719 and lower adjustment mandrel 710 is actuatable while downhole or in-situ from the lower axial position to the upper axial position.

Referring now to FIGS. 34-39, initially, it may be understood that upper housing 310 is shown as transparent in FIGS. 35-39 for the purpose of clarity. Similar to bend adjustment assembly 300 described above, the bend adjustment assembly 705 of mud motor 700 is configured to shift from the first configuration 707 (shown in FIGS. 36 and 37) to the second configuration 709 (shown in FIG. 38) automatically upon reaching the predefined depth in wellbore 16. Particularly, mud motor 700 may be operated to drill wellbore 16 with bend adjustment assembly 705 locked into the first configuration 707 until mud motor 700 reaches the predefined depth at which point locking assembly 400 is configured to automatically unlock bend adjustment assembly 705 such that bend adjustment assembly 705 may be actuated automatically from the first configuration 707 to the second configuration 709.

It may be understood that in the first configuration 707 the extension 328 of lower housing 320 is oriented angularly relative to lower adjustment mandrel 710 whereby both shoulders 328S of extension 328 are circumferentially spaced from the corresponding shoulders 715A and 715B of mandrel 710. Additionally, in the first configuration 707 relative rotation between lower housing 320 and lower adjustment mandrel 710 is restricted via interlocking engagement between castellations 333 of lower housing 320 and castellations 717 of lower adjustment mandrel 710 prior to mud motor 700 achieving the predefined depth. Once bend adjustment assembly 705 is unlocked from the first configuration 707 via the bursting of rupture disk 426 of locking assembly 400 as described in further detail above in relation to bend adjustment assembly 700 may be cycled or toggled indefinitely between the second configuration 709 and third configuration 711 (shown in FIGS. 38 and 39) an unlimited number of times without needing to retrieve the mud motor 700 from the wellbore 16.

In this exemplary embodiment, bend adjustment assembly 705 may be shifted from the second configuration 709 to the third configuration 711 by ceasing the pumping of drilling fluid from surface pump 23 for a first time period to shift the locking piston 380 of bend adjustment assembly 705 into the unlocked position. Either concurrent with the first time period or following the initiation of the first time period, rotary system 24 may be activated to rotate drillstring 21 at an actuation rotational speed (surface pump 23 is also activated to flow at a first actuation flowrate) for a second time period to apply reactive torque from the sidewall 19 of wellbore 16 to the bearing housing 210 of bearing assembly and thereby rotate lower offset housing 320 relative to the lower adjustment mandrel 710 in a first rotational direction, which thereby shifts bend adjustment assembly 705 into the third configuration 711. With bend adjustment assembly 705 in the third configuration 711, surface pump 23 may be operated either at a second actuation flowrate for a third time period or operated immediately at a maximum drilling flowrate of the well system comprising mud motor 700 to thereby shift locking piston 380 into the locked position, locking bend adjustment assembly 705 into the third configuration 711. This exemplary embodiment allows for all three of the deflection angles $\theta_1$-$\theta_3$ to be non-zero in magnitude. For example, in some embodiments, the first deflection angle corresponding to the first configuration 707 of bend adjustment assembly 705 is approximately 1.5 degrees, the second deflection angle corresponding to the second configuration 709 of bend adjustment assembly 705 is approximately 2.12 degree, and the third deflection angle corresponding to the third configuration 711 of bend adjustment assembly 705 is approximately 1.15 degrees.

In this exemplary embodiment, bend adjustment assembly 705 may be shifted from the third configuration 711 to the second configuration 709 by ceasing the rotation of drillstring 21 by rotary system 24 while also ceasing the pumping of drilling fluid from surface pump 23 at a second flowrate to thereby shift locking piston 380 of the bend adjustment assembly 705 into the unlocked position. With locking piston 380 disposed in the unlocked position, surface pump 23 may resume pumping drilling fluid into drill string 21 while rotary system 24 remains inactive, thereby rotating lower adjustment mandrel 710 in a second rotational direction, opposite the first rotational direction, to shift bend adjustment assembly 705 into the second configuration 709. With bend adjustment assembly 705 now disposed in second configuration 709, the flowrate of drilling fluid from surface pump 23 is increased from the second flowrate to a third flowrate to shift locking piston 380 into the locked position, thus locking bend adjustment assembly 705 in the second configuration 709. Additionally, a pressure signal provided by flow restrictor 123 may provide a surface indication of the actuation of bend adjustment assembly 705 switching from the third configuration 711 to the second configuration 709.

In an alternative embodiment, bend adjustment assembly 705 may not include actuator assembly 400. In this alternative embodiment, first deflection angle $\theta_1$ is equal or substantially equal to the second deflection angle $\theta_2$. For example, in this alternative embodiment, the first deflection angle $\theta_1$ is approximately 2.1 degrees, the second deflection angle $\theta_2$ is approximately 2.15 degrees, and the third deflection angle $\theta_3$ is approximately 1.5 degrees. For applications that only require unlocking and two distinct deflection angles and no need to return to the first or second deflection angle the actuator assembly 400 in this alternative embodiment may be eliminated.

Figure 40:
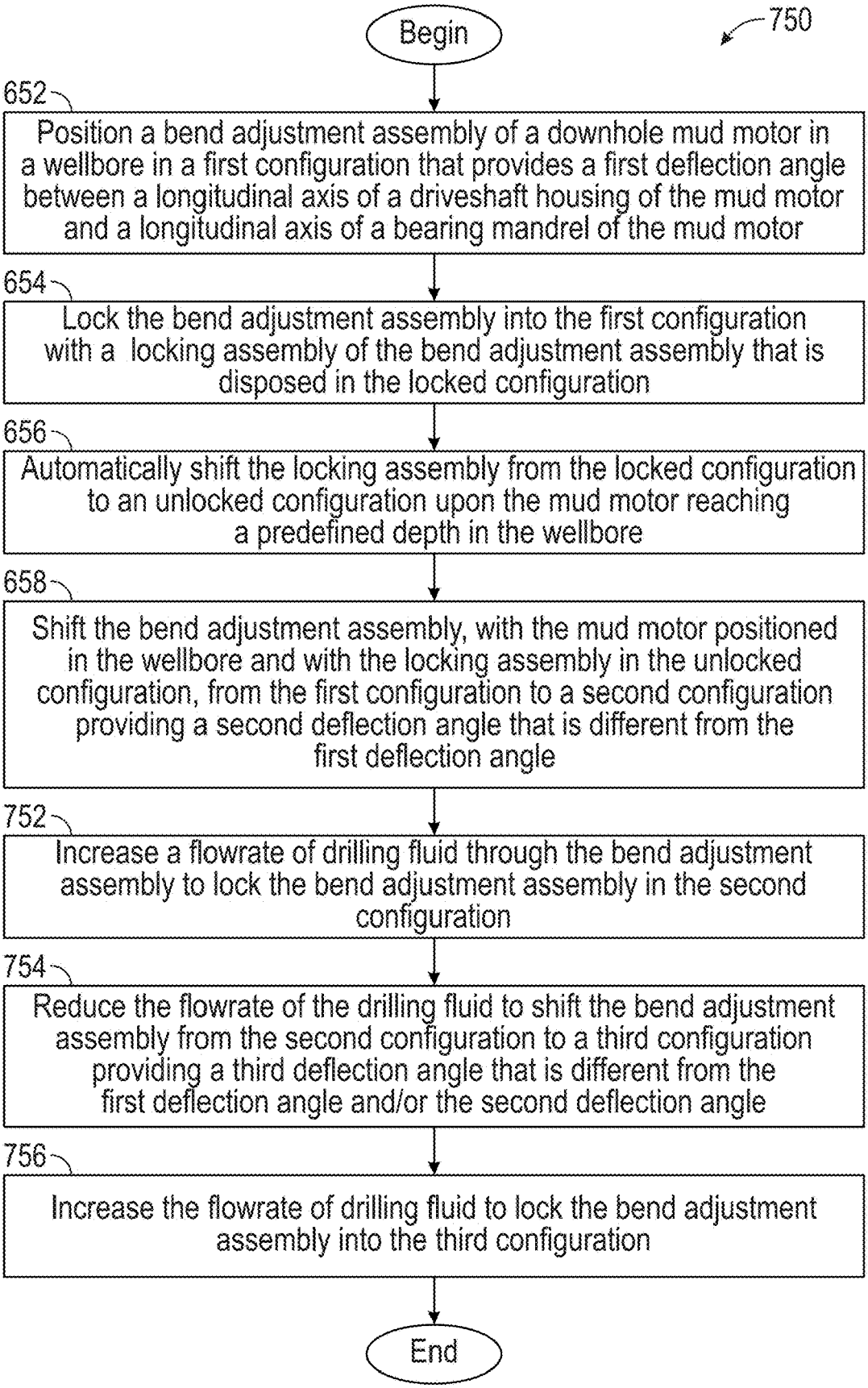
FIG. 40 is a flowchart of another embodiment of a method for forming a deviated wellbore using a downhole mud motor in accordance with principles disclosed herein.

Referring to FIG. 40, an embodiment of a method 750 for adjusting a deflection angle of a downhole mud motor disposed in a borehole is shown. It may be understood that in at least some embodiments method 750 may be performed using the mud motor 700 shown in FIG. 34. Method 750 includes features in common with the method 600 shown in FIG. 33. Particularly, in addition to previously described blocks 652-658, method 750 includes block 752 where a flowrate of drilling fluid is increased through the bend adjustment assembly to lock the bend adjustment assembly in the second configuration. Block 752 may be performed when the BHA comprising the mud motor is "off-bottom" where WOB is not applied to the BHA. Alternatively, block 752 may be performed when the BHA comprising the mud motor is "on-bottom" with WOB being actively applied to the BHA.

At block 756, method 750 includes reducing the flowrate of the drilling fluid to shift the bend adjustment assembly from the second configuration to a third configuration providing a third deflection angle that is different from the first deflection angle and/or the second deflection angle. In some embodiments, the first deflection angle is approximately 1.5 degrees, the second deflection angle is approximately 2.12 degree, and the third deflection angle is approximately 1.15 degrees. In other embodiments, the first deflection angle is approximately 2.1 degrees, the second deflection angle is approximately 2.15 degree, and the third deflection angle is approximately 1.5 degrees. However, it may be understood the magnitude of each deflection angle may vary in other embodiments. At block 758, method 750 includes increasing the flowrate of drilling fluid to lock the bend adjustment assembly in the third configuration. In some embodiments, the first configuration corresponds to the first configuration 707 (shown in FIGS. 36 and 37) of bend adjustment assembly 705 shown in FIG. 34, the second configuration corresponds to the second configuration 709 of bend adjustment assembly 705, and the third configuration corresponds to the third configuration 711 of bend adjustment assembly 705.

While disclosed embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A downhole mud motor positionable in a wellbore, comprising:

a driveshaft housing;

a driveshaft rotatably disposed in the driveshaft housing;

a bearing mandrel coupled to the driveshaft;

a bend adjustment assembly including a first configuration that provides a first deflection angle between a longitudinal axis of the driveshaft housing and a longitudinal axis of the bearing mandrel;

wherein the bend adjustment assembly includes a second configuration that provides a second deflection angle between the longitudinal axis of the driveshaft housing and the longitudinal axis of the bearing mandrel that is different from the first deflection angle, and wherein the bend adjustment assembly is configured to shift between the first configuration and the second configuration when positioned in the wellbore; and a locking assembly comprising a valve element, the locking assembly having a locked configuration configured to lock the bend adjustment assembly into one of the first configuration and the second configuration and corresponding to a closed state of the valve element that restricts fluid flow in either flow direction across the valve element, and an unlocked configuration corresponding to an open state of the valve element.

2. The downhole mud motor of claim 1, wherein the valve element comprises a rupture disk.

3. The downhole mud motor of claim 1, wherein the valve element is pressure activated.

4. The downhole mud motor of claim 1, wherein the locking assembly comprises:

a locking sleeve including a locked position associated with the locked configuration and an unlocked position axially spaced from the locked position and associated with the unlocked configuration, and wherein the locking sleeve is configured to shift from the locked position to the unlocked position in response to shifting of the valve element from the closed state to the open state.

5. The downhole mud motor of claim 1, wherein:

the bend adjustment assembly comprises an offset housing and an adjustment mandrel having a first relative angular orientation associated with the first configuration and a second relative angular orientation associated with the second configuration.

6. A downhole mud motor positionable in a wellbore, comprising:

a driveshaft housing;

a driveshaft rotatably disposed in the driveshaft housing;

a bearing mandrel coupled to the driveshaft;

a bend adjustment assembly comprising an offset housing and an adjustment mandrel having a first relative angular orientation associated with a first configuration of the bend adjustment assembly and a second relative angular orientation associated with a second configuration of the bend adjustment assembly;

wherein the first configuration of the bend adjustment assembly provides a first deflection angle between a longitudinal axis of the driveshaft housing and a longitudinal axis of the bearing mandrel, and the second configuration of the bend adjustment assembly provides a second deflection angle between the longitudinal axis of the driveshaft housing and the longitudinal axis of the bearing mandrel that is different from the first deflection angle, and wherein the bend adjustment assembly is configured to shift between the first configuration and the second configuration when positioned in the wellbore; and a locking assembly comprising a locking piston configured to lock the offset housing and the adjustment mandrel in the first relative angular orientation when in a first position, and to unlock the offset housing and the adjustment mandrel from the first relative angular orientation when in a second position that is spaced from the first position whereby the offset housing and the adjustment mandrel are shiftable from the first relative angular orientation to the second relative angular orientation.

7. The downhole mud motor of claim 6, wherein the locking assembly comprises a first locking pin configured to lock the locking piston in the first position.

8. The downhole mud motor of claim 7, wherein the locking assembly comprises a second locking pin configured to lock the locking piston in a second position configured to lock the offset housing and the adjustment mandrel in the second relative angular orientation.

9. The downhole mud motor of claim 6, wherein the adjustment mandrel and offset housing comprise interlocking castellations configured to lock the offset housing and adjustment mandrel in the first relative angular orientation.

10. The downhole mud motor of claim 9, wherein:

the locking assembly comprises a locking sleeve including a locked position and an unlocked position axially spaced from the locked position;

the adjustment mandrel has a first axial position wherein the interlocking castellations between the adjustment mandrel and offset housing are matingly engaged, and a second axial position wherein the interlocking castellations between the adjustment mandrel and offset housing are disengaged; and the adjustment mandrel shifts from the first axial position to the second axial position in response to the locking sleeve shifting from the locked position to the unlocked position.

11. The downhole mud motor of claim 10, wherein:

the locking assembly comprises a shear pin that holds the adjustment mandrel in the first axial position; and the locking assembly comprises a first locking pin configured to hold the locking piston axially separated from the adjustment mandrel when the locking sleeve is in the locked position.

12. The downhole mud motor of claim 11, wherein:

the first locking pin is configured to release the locking piston into contact with the adjustment mandrel when the locking sleeve is in the unlocked position; and the locking piston is configured to apply force to the adjustment mandrel to fracture the shear pin and permit the adjustment mandrel to shift from the first axial position to the second axial position.

13. A downhole mud motor positionable in a wellbore, comprising:

a driveshaft housing;

a driveshaft rotatably disposed in the driveshaft housing;

a bearing mandrel coupled to the driveshaft;

a bend adjustment assembly comprising an offset housing and an adjustment mandrel having a first axial position associated with a first configuration of the bend adjustment assembly and a second axial position, spaced from the first axial position, and associated with a second configuration of the bend adjustment assembly;

wherein the first configuration of the bend adjustment assembly provides a first deflection angle between a longitudinal axis of the driveshaft housing and a longitudinal axis of the bearing mandrel, and the second configuration of the bend adjustment assembly provides a second deflection angle between the longitudinal axis of the driveshaft housing and the longitudinal axis of the bearing mandrel that is different from the first deflection angle, and wherein the bend adjustment assembly is configured to shift between the first configuration and the second configuration when positioned in the wellbore; and a locking assembly comprising a locking piston configured to lock the adjustment mandrel in the first axial position when in a first position, and to unlock the adjustment mandrel from the first axial position when in a second position that is spaced from the first position whereby the adjustment mandrel is shiftable from the first axial position to the second axial position.

14. The downhole mud motor of claim 13, wherein:

the locking assembly comprises a locking sleeve including a locked position and an unlocked position axially spaced from the locked position; and the adjustment mandrel shifts from the first axial position to the second axial position in response to the locking sleeve shifting from the locked position to the unlocked position.

15. The downhole mud motor of claim 13, wherein the adjustment mandrel and offset housing comprise interlocking castellations configured to lock the offset housing and adjustment mandrel in a predefined relative angular orientation.

16. The downhole mud motor of claim 13, wherein the locking assembly comprises a shear pin that holds the adjustment mandrel in the first axial position.

17. The downhole mud motor of claim 16, wherein:

the locking assembly comprises a locking sleeve including a locked position and an unlocked position axially spaced from the locked position;

the locking assembly comprises a first locking pin configured to hold the locking piston axially separated from the adjustment mandrel when the locking sleeve is in the locked position; and the first locking pin is configured to release the locking piston into contact with the adjustment mandrel when the locking sleeve is in the unlocked position.

18. The downhole mud motor of claim 17, wherein the locking piston is configured to apply force to the adjustment mandrel to fracture the shear pin and permit the adjustment mandrel to shift from the first axial position to the second axial position.

19. The downhole mud motor of claim 13, wherein the locking assembly comprises:

a locking sleeve including a locked position and an unlocked position axially spaced from the locked position, wherein the adjustment mandrel shifts from the first axial position to the second axial position in response to the locking sleeve shifting from the locked position to the unlocked position; and a valve element having a closed state and an open state, and wherein the locking sleeve is configured to shift from the locked position to the unlocked position in response to shifting of the valve element from the closed state to the open state.

20. The downhole mud motor of claim 19, wherein the valve element comprises a rupture disk.

* * * * *